US010618157B2

(12) United States Patent
Hashimoto et al.

(10) Patent No.: US 10,618,157 B2
(45) Date of Patent: Apr. 14, 2020

(54) POWER-ACTUATED TOOL

(71) Applicant: HITACHI KOKI CO., LTD., Tokyo (JP)

(72) Inventors: Hideyuki Hashimoto, Ibaraki (JP); Atsuyuki Kikuchi, Ibaraki (JP); Shingo Yamazaki, Ibaraki (JP); Kuniaki Kanbe, Ibaraki (JP); Satoshi Abe, Ibaraki (JP); Daijiro Tanabe, Ibaraki (JP); Takehiro Ookubo, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 558 days.

(21) Appl. No.: 15/027,226

(22) PCT Filed: Dec. 18, 2014

(86) PCT No.: PCT/JP2014/006326

§ 371 (c)(1),
(2) Date: Apr. 4, 2016

(87) PCT Pub. No.: WO2015/093057

PCT Pub. Date: Jun. 25, 2015

(65) Prior Publication Data

US 2016/0229045 A1 Aug. 11, 2016

(30) Foreign Application Priority Data

Dec. 20, 2013 (JP) ..... 2013-263243
Dec. 20, 2013 (JP) ..... 2013-264052

(51) Int. Cl.
*B25F 5/00* (2006.01)
*B25D 16/00* (2006.01)
(Continued)

(52) U.S. Cl.
CPC ..... *B25F 5/008* (2013.01); *B25D 16/00* (2013.01); *B25D 17/043* (2013.01); *B25D 17/20* (2013.01);
(Continued)

(58) Field of Classification Search
CPC ..... B25D 16/00; B25D 17/043; B25D 17/20; B25D 2211/068; B25D 2217/0061;
(Continued)

(56) References Cited

U.S. PATENT DOCUMENTS 5,456,324 A * 10/1995 Takagi ..... B25D 16/006 173/109
6,123,158 A * 9/2000 Steffen ..... H02K 11/33 173/117
(Continued)

FOREIGN PATENT DOCUMENTS

CN 1663749 A 9/2005
CN 102848357 A 1/2013
(Continued)

OTHER PUBLICATIONS

Office Action issued in related Japanese Patent Application No. 2013-263243, dated May 19, 2017.
(Continued)

*Primary Examiner* — Andrew M Tecco
*Assistant Examiner* — Nicholas E Igbokwe
(74) *Attorney, Agent, or Firm* — McDermott Will & Emery LLP

(57) ABSTRACT

An electric power tool has a brushless motor for driving a tip tool, and a motor case is at least partly covered by a motor housing made of aluminum alloy and exposed to an outside. A control board provided with a control circuit for controlling the rotation of the brushless motor is disposed adjacent to the motor housing. The brushless motor and a control
(Continued)

board are cooled by cooling air generated by a fun, thereby enhancing the cooling characteristics of the motor control circuit.

16 Claims, 17 Drawing Sheets

(51) Int. Cl.
*B25D 17/20* (2006.01)
*B25F 5/02* (2006.01)
*B25D 17/04* (2006.01)

(52) U.S. Cl.
CPC ..... *B25F 5/02* (2013.01); *B25D 2211/068* (2013.01); *B25D 2217/0061* (2013.01); *B25D 2250/121* (2013.01); *B25D 2250/195* (2013.01); *B25D 2250/221* (2013.01)

(58) Field of Classification Search
CPC ..... B25D 2250/121; B25D 2250/195; B25D 2250/221; B25F 5/008; B25F 5/02
USPC ..... 173/217, 171; 310/50
See application file for complete search history.

(56) References Cited

U.S. PATENT DOCUMENTS

| | | | | |
|---|---|---|---|---|
| 6,213,224 | B1 * | 4/2001 | Furuta | B25B 21/00 173/170 |
| 7,836,971 | B2 | 11/2010 | Kikuchi et al. | |
| 2003/0107273 | A1 | 6/2003 | Ikeda et al. | |
| 2004/0124721 | A1 * | 7/2004 | Pfisterer | B25D 17/20 310/51 |
| 2006/0255756 | A1 | 11/2006 | Iwata et al. | |
| 2009/0223693 | A1 * | 9/2009 | Aoki | B25D 16/00 173/211 |
| 2009/0321101 | A1 * | 12/2009 | Furusawa | B25D 17/043 173/162.2 |
| 2010/0038105 | A1 * | 2/2010 | Kikuchi | B25D 17/24 173/162.2 |
| 2010/0253162 | A1 * | 10/2010 | Sakamaki | B25D 16/00 310/50 |
| 2011/0171887 | A1 * | 7/2011 | Tanimoto | B24B 23/028 451/359 |
| 2012/0014065 | A1 * | 1/2012 | Haga | B25B 21/002 361/697 |
| 2012/0241048 | A1 * | 9/2012 | Kato | B25F 5/021 144/136.95 |
| 2012/0279740 | A1 | 11/2012 | Furusawa et al. | |
| 2013/0014967 | A1 * | 1/2013 | Ito | B25F 5/00 173/93 |
| 2014/0209341 | A1 | 7/2014 | Nishikawa et al. | |

FOREIGN PATENT DOCUMENTS

| | | | |
|---|---|---|---|
| EP | 1715565 | A1 | 10/2006 |
| EP | 2103396 | A1 | 9/2009 |
| JP | H06-066975 | U | 9/1994 |
| JP | H11-010558 | A | 1/1999 |
| JP | 2000-052279 | A | 2/2000 |
| JP | 2004-159464 | A | 6/2004 |
| JP | 2006-212758 | A | 8/2006 |
| JP | 2007-331072 | A | 12/2007 |
| JP | 2011-131364 | A | 7/2011 |
| JP | 2011-148069 | A | 8/2011 |
| JP | 2011-161605 | A | 8/2011 |
| JP | 2012-020363 | A | 2/2012 |
| JP | 2012-139783 | A | 7/2012 |
| JP | 2013-193133 | A | 9/2013 |
| WO | 2013/027365 | A1 | 2/2013 |
| WO | 2013/122108 | A1 | 8/2013 |
| WO | 2013/136788 | A1 | 9/2013 |

OTHER PUBLICATIONS

Communication pursuant to Article 94(3), which issued in corresponding European Patent Application No. 14824136.7, dated Mar. 15, 2018.

Office Action issued in corresponding Chinese Patent Application No. 201480069042.9, dated Mar. 26, 2018.

International Search Report and Written Opinion issued in corresponding International Application No. PCT/JP2014/006326, dated Mar. 5, 2015.

Office Action issued in corresponding Chinese Patent Application No. 2014800690429, dated Jun. 20, 2017.

Office Action issued in corresponding Japanese Patent Application No. 2013-263243, dated Sep. 5, 2017.

Japanese Office Action issued in corresponding Japanese Patent Application No. 2013-263243, dated May 8, 2018, with English Translation.

Office Action issued in corresponding Japanese Patent Application No. 2013-264052, dated Jun. 27, 2017.

* cited by examiner

POWER-ACTUATED TOOL

CROSS REFERENCE

This application is the U.S. National Phase under 35 US.C. § 371 of International Application No. PCT/JP2014/006326, filed on Dec. 18, 2014, which claims the benefit of Japanese Application No. 2013-263243, filed on Dec. 20, 2013, and Japanese Application No. 2013-264052, filed on Dec. 20, 2013, the entire contents of each are hereby incorporated by reference.

TECHNICAL FIELD

This invention relates to an electric power tool configured to drive a tip tool by an electric motor.

BACKGROUND ART

As an electric power tool configured to drive a tip tool by an electric motor serving as a driving source, hammer, hammer drill, grinder and the like are known. Each of the hammer and the hammer drill has a drill bit, anchor drill and the like serving as a tip tool, and is also referred to as "impact tool". These impact tools are used to cause the tip tool to apply an impact to a workpiece, or to rotate the tip tool while applying an impact to a workpiece. The grinder is an electric power tool for rotating a grinding wheel serving as the tip tool to grind a workpiece, and also referred to as "disc grinder" or "disc sander". In addition, impact driver, impact wrench, and cutter are known as an electric power tools for driving a tip tool to machine a workpiece.

An electric power tool includes: an electric motor for driving a tip tool; and a motion converting mechanism for converting the rotation motion of a motor output shaft into rotation motion or impact-applying motion of the tip tool. For example, patent literature 1 discloses an impact tool working as an electric power tool which causes a tip tool to apply impact to a workpiece. According to this impact tool, a piston is reciprocably housed in a cylinder fitted with a tool holder, and an electric motor for driving the piston is incorporated in a housing.

CITATION LIST

Patent Literature

PTL 1: Japanese Patent Application Laid-Open Publication No.: 2007-331072

SUMMARY OF INVENTION

Technical Problem

In order to cool the electric motor, the motor output shaft is provided with a fan. Cooling air generated by the fan flows through a gap between the rotor and the stator of the electric motor so as to cool the electric motor.

In order to control the rotation number of the electric motor, a control board having a motor control circuit is disposed in the housing of the electric power tool. A conventional electric power tool does not have a mechanism for cooling the control board. When a brushless motor is used as the electric motor, however, the cooling performance of the control board must be improved. The brushless motor has an inverter circuit provided with a switching element for controlling a commutation action on a coil. Since the switching element is mounted on the control board, and generates heat when performing a current control operation, it is necessary to cool the control board to suppress heat generated from the inverter circuit, thereby improving the durability of the motor control circuit.

An object of the present invention is to improve the cooling characteristics of a motor control circuit which controls a motor for driving a tip tool.

Another object of the present invention is to improve the cooling characteristics of a motor for driving a tip tool.

Solution to Problem

An electric power tool according to the present invention comprises: a brushless motor for driving a tip tool; and a motor housing made of aluminum alloy, the motor housing at least partly covering the motor case, the motor housing being exposed to an exterior portion, wherein a control board provided with a control circuit for controlling the rotation of the brushless motor is disposed adjacent to the motor housing.

Advantageous Effects of Invention

According to the present invention, since the control board is disposed adjacent to the motor housing made of aluminum alloy, when heat is released from such an electronic component as a switching element making up the motor control circuit mounted on the control board, heat from the electronic component is transmitted to the motor housing having a heat dissipation property. Therefore, cooling characteristics, that is, heat dissipation characteristics of the motor control circuit of the brushless motor are improved.

DESCRIPTION OF EMBODIMENTS

Figure 1A:
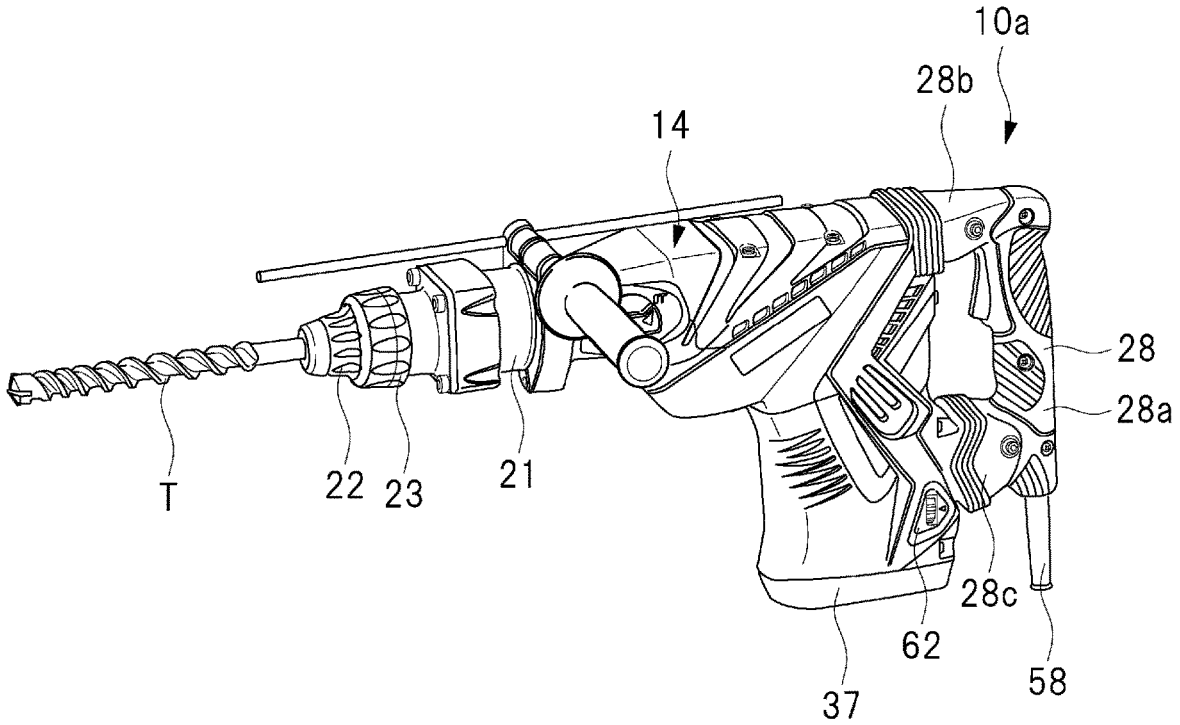
FIG. 1A is a perspective view showing an appearance of an impact tool as one example of an electric power tool.

Hereinafter, embodiments of the present invention will be described in detail with reference to the drawings. In the drawings, members the same as each other are denoted by the same reference characters.

Figure 2:
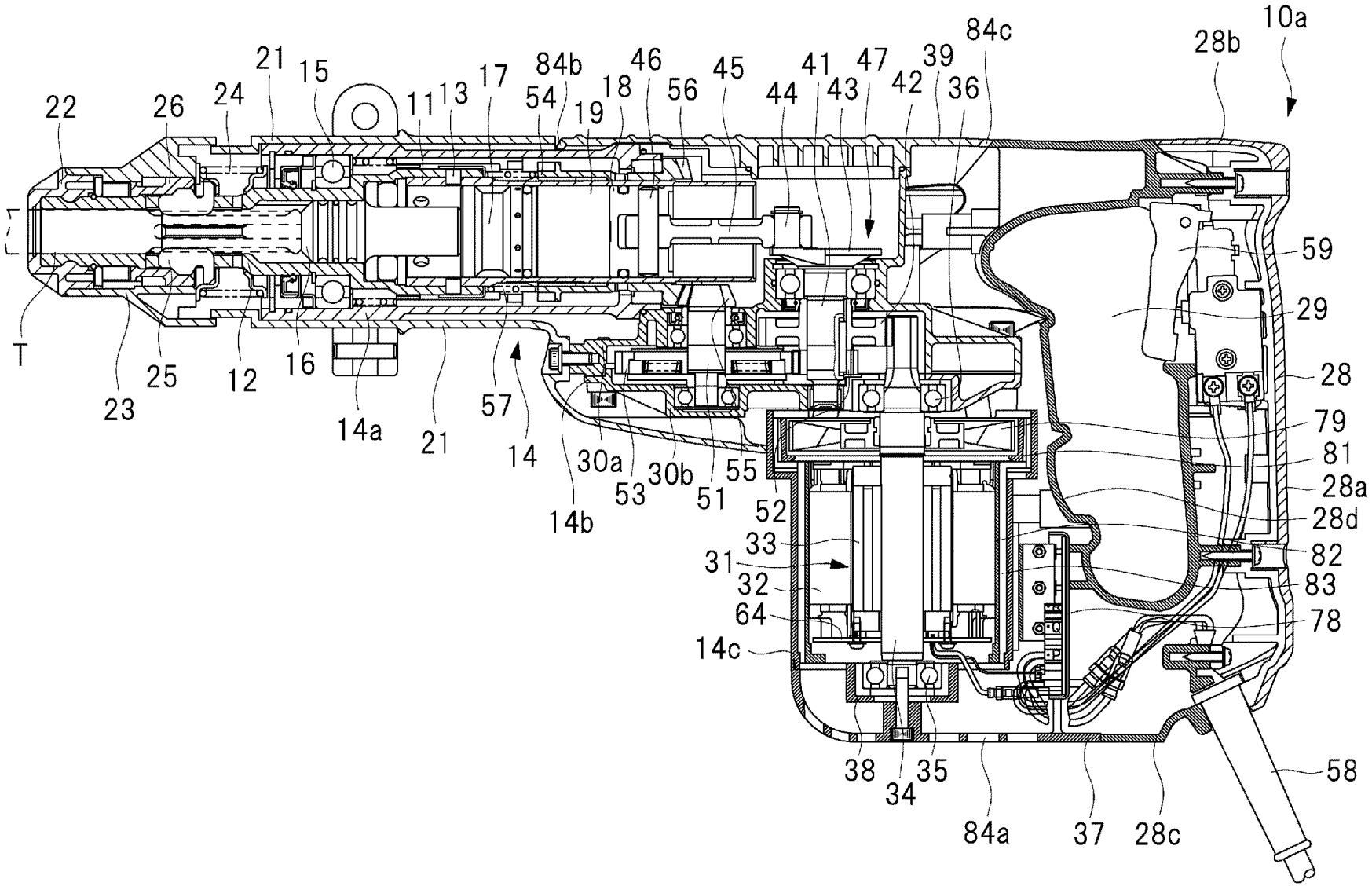
FIG. 2 is a longitudinal sectional view of the impact tool shown in FIG. 1A.

An electric power tool shown in FIGS. 1A and 2 is an impact tool 10*a* also referred to as "hammer drill". The impact tool 10*a* has a drill bit, that is, a tip tool "T" detachably attached thereto. Rotation and impact are applied to the drill bit, i.e., tip tool "T" when the impact tool 10*a* is used to perform a holing process, etc., on a workpiece, such as concrete and stone. The impact tool 10*a* is used in two work modes, i.e., an impact mode for applying impact to the tip tool "T" and a rotation/impact mode for applying impact to the tip tool "T" and rotating the tip tool "T".

As shown in FIG. 2, the impact tool 10*a* has a cylinder 11 to which the tip of a cylindrical tool holder 12 is fixed with a pin 13. The tool holder 12 is supported on a cylinder housing 14*a* via a bearing 15. The cylinder 11 and the tool holder 12 are rotatably attached in the cylinder housing 14*a*. When the cylinder 11 is rotated with the tool holder 12 holding the tip tool "T" attached thereto, the tip tool "T" is rotated.

A tip part of a hammer 16 is incorporated in the base end of the tool holder 12 so that the hammer 16 can be reciprocated in an axial direction, while the base end of the hammer 16 projects into the cylinder 11. In the cylinder 11, a striker 17 for applying impact to the hammer 16 is attached and axially reciprocable, and a piston 18 is fitted in the rear end part of the cylinder 11 and axially reciprocable. An air compartment 19 is formed between the striker 17 and the piston 18. When the piston 18 is driven forward, the piston 18 compresses air inside the air compartment 19, thereby driving the striker 17 forward, and the striker 17 strikes the hammer 16, thereby applying the impact of the striker 17 to the tip tool "T" via the hammer 16.

The cylinder housing 14*a* is fitted with a front end cover 21 making up part of the cylinder housing 14*a*. A rubber end cap 22 is attached to the tip of the tool holder 12. An attachable/detachable sleeve 23 is attached to the exterior of the end cap 22 and axially reciprocable, and attachable/detachable sleeve 23 is kept pushed by a spring force applied thereto by a coil spring 24 in the direction of moving away from the cylinder housing 14*a*, that is, the forward direction. The tool holder 12 is fitted with a radially movable engagement roller, i.e., engagement member 25 which engages with a groove formed on the tip tool "T". The attachable/detachable sleeve 23 has a fastening ring 26. As shown in FIG. 2, when the fastening ring 26 forces the engagement member 25 to project radially inward, the tip tool "T" is fastened to the tool holder 12. When the attachable/detachable sleeve 23 is moved backward against the spring force, the fastening ring 26 is disengaged from the engagement member 25. In this state, pulling the tip tool "T" causes the engagement member 25 to move radially outward, which allows the tip tool "T" to be removed. In contrast, when the tip tool "T" is inserted in the tip of the tool holder 12 and the tool holder 12 is moved forward by the spring force with the attachable/detachable sleeve 23 is held in its moved backward position, the tip tool "T" is attached to the tool holder 12 and is fastened by the engagement member 25.

A gear housing 14*b* is formed on the rear end part of the cylinder housing 14*a*, and a motor housing 14*c* is connected to the gear housing 14*b*. The motor housing 14*c* is set almost right angles with the cylinder housing 14*a*. These housings 14*a* to 14*c* make up a housing 14 of the impact tool 10*a*. On the rear part of the housing 14, an operating handle 28 is provided so as to project backward. The handle 28 has a body 28*a* extending almost perpendicular to the cylinder 11 and two legs 28*b* and 28*c* formed on both ends of the body 28*a* such that they are separated from each other across the body 28*a*. The upper end of the body 28*a*, i.e., part of the body 28*a* which is closer to the gear housing is connected integrally to the leg 28*b* on the upper side, while the lower end of the body 28*a*, i.e., the part of body 28*a* which is closer to the motor housing is connected integrally to the leg 28*c* on the lower side. Both legs 28*b* and 28*c* are connected integrally via a connection wall 28*d*, which makes up the housing 14. The legs 28*b* and 28*c* are attached to the back face of the housing 14, and a grip space 29 is formed between the body 28*a* and the housing 14. When a worker holds the body 28*a* of the handle 28 and uses the impact tool 10*a* to carry out a holing process, etc., on a workpiece, the worker puts his or her fingers in the grip space 29. The connection wall 28*d* forms the back wall of the housing 14 and is counter to the body 28*a* of the handle 28. The surface of body 28*a* which faces the grip space 29 is therefore counter to the back face of the housing 14.

When the worker carries out work using the impact tool 10*a*, the worker usually holds the handle 28 in his or her hand so that the leg 28*b* is located on the upper side, that is, the cylinder housing 14*a* is located above the motor housing 14*c*. The vertical positional relation between the leg 28*b* and the leg 28*c* and between the cylinder housing 14*a* and the motor housing 14*c* as shown in FIG. 2 indicates the position of the impact tool 10*a* in its normal use. The cylinder housing 14*a* and the motor housing 14*c* are assembled together via the gear housing 14*b*, which is composed of an upper side part 30*a* closer to the cylinder housing 14*a* and a lower side part 30*b* closer to the motor housing 14*c*.

The motor housing 14*c* has a brushless motor 31 housed therein. The brushless motor 31 has a cylindrical stator 32 wound with coils, and a rotor 33 incorporated in the stator 32. The rotor 33 is fitted with an output shaft 34, which is set in the direction perpendicular to the reciprocation direction of the cylinder 11, and outputs the rotating drive force of the motor 31. The base end of the output shaft 34 is supported rotatably by a bearing 35, while the output end of the output shaft 34 is supported rotatably by a bearing 36. The bearing 35 is incorporated in a retainer 38 connected integrally to the bottom wall of the motor housing 14*c* to make up part of the motor housing 14*c*. The retainer 38 is covered with a bottom cover 37 attached to the housing 14. The bearing 36 is attached to the lower side portion 30*b* of the gear housing 14*b*. To the top face of the rear side of the housing 14, a top cover 39 is attached. Each of the top cover 39 and the bottom cover 37 makes up part of the housing 14.

To convert the rotation of the output shaft 34 of the motor 31 into the reciprocation of the piston 18, a crankshaft 41 is rotatably attached in the gear housing 14*b*. The crankshaft 41 is set parallel with the output shaft 34 and is located closer to the tool holder. A large-diameter pinion gear 42 fitted on the crankshaft 41 is engaged with a gear fitted on the tip of the output shaft 34. To the tip of the crankshaft 41, an eccentric member 43 functioning as a crank weight is attached, and the eccentric member 43 has a crankpin 44 attached at a location eccentric to the rotation center of the crankshaft 41. One end of a connecting rod 45 is fitted rotatably in the crankpin 44, while the other end of the same is fitted swingably in a piston pin 46 attached to the piston 18. Hence the rotation of the crankshaft 41 driven by the output shaft 34 is converted into the reciprocation of the piston 18 perpendicular to the output shaft 34 through a motion converting mechanism 47 composed of the eccentric member 43, the connecting rod 45, etc. The eccentric member 43, the crankpin 44, etc., are covered with the top cover 39.

To transmit the rotation of the output shaft 34 to the cylinder 11 to rotate it, a rotation transmission shaft 51 is supported rotatably in the gear housing 14*b*. The rotation transmission shaft 51 is fitted with a large-diameter pinion gear 53 which engages with a small-diameter pinion gear 52 fitted on the crankshaft 41. Through a motion converting mechanism having such gears, the rotation of the output shaft 34 is transmitted to the rotation transmission shaft 51. A driven sleeve 54 is fitted on the exterior of the cylinder 11 and axially movable. On the base end of the driven sleeve 54, a driven bevel gear 56 is provided, which is engaged with a driving bevel gear 55 fitted on the tip of the rotation transmission shaft 51. A key member (not shown) is provided between the driven sleeve 54 and the cylinder 11. When the driven sleeve 54 is moved backward to a position at which the driven bevel gear 56 engages with the driving bevel gear 55, the driven sleeve 54 is engaged with the cylinder 11 via the key member, as shown in FIG. 2. As a result, the rotation of the output shaft 34 is transmitted to the cylinder 11 to rotate it, in which case the impact tool 10*a* operates in its rotation/impact mode. In contrast, when the drive sleeve 54 is moved forward, the driven sleeve 54 is disengaged from the cylinder 11, in which case no torque is transmitted to the cylinder 11 and therefore the impact tool 10*a* operates in its impact mode.

To apply a spring force to the driven sleeve 54 in the direction of moving it backward, a coil spring 57 is attached in the cylinder housing 14*a*. To move the driven sleeve 54 to a position of engagement with the driving bevel gear 55 and to a position of disengagement from the driving bevel gear 55, a mode shifting lever (not shown) is provided to the housing 14. The worker operates the lever to shift the work mode to the impact mode for applying impact to the tip tool "T" and to the rotation/impact mode for applying impact to the tip tool "T" and rotating the tip tool "T".

The brushless motor 31 is supplied with power from a commercial power supply, and a feeder cable 58 is attached to the handle 28. FIG. 2 shows part of the feeder cable 58, which has a plug (not shown) attached to its tip. To switch the operation state of the motor 31 between a state of drive and a state of stoppage, a trigger switch, i.e., operating switch 59 is provided to the body 28*a* of the handle 28, as shown in FIG. 2.

The housing 14 is provided with a pilot lamp (not shown) serving as an indicator means. This pilot lamp turns on when the plug is inserted in a commercial power supply socket. As shown in FIG. 1(A), a speed setting dial 62 serving as a speed setting means for inputting the rotating speed of the motor 31 is disposed on a side face of the rear of the housing 14. This speed setting dial 62 is operated to input the rotating speed of the motor 31. To indicate the rotating speed of the motor 31, a speed indicator (not shown) serving as an indicator means is disposed on the housing 14. Speed setting means include a dial-type means and a button-type means, and the above dial-type speed setting means may be replaced with a button-type speed setting means. An abnormal condition indicating lamp may be provided to the housing 14, as an indicator means which turns on when a load applied to the tip tool "T" becomes equal to or larger than a given load.

Figure 6:
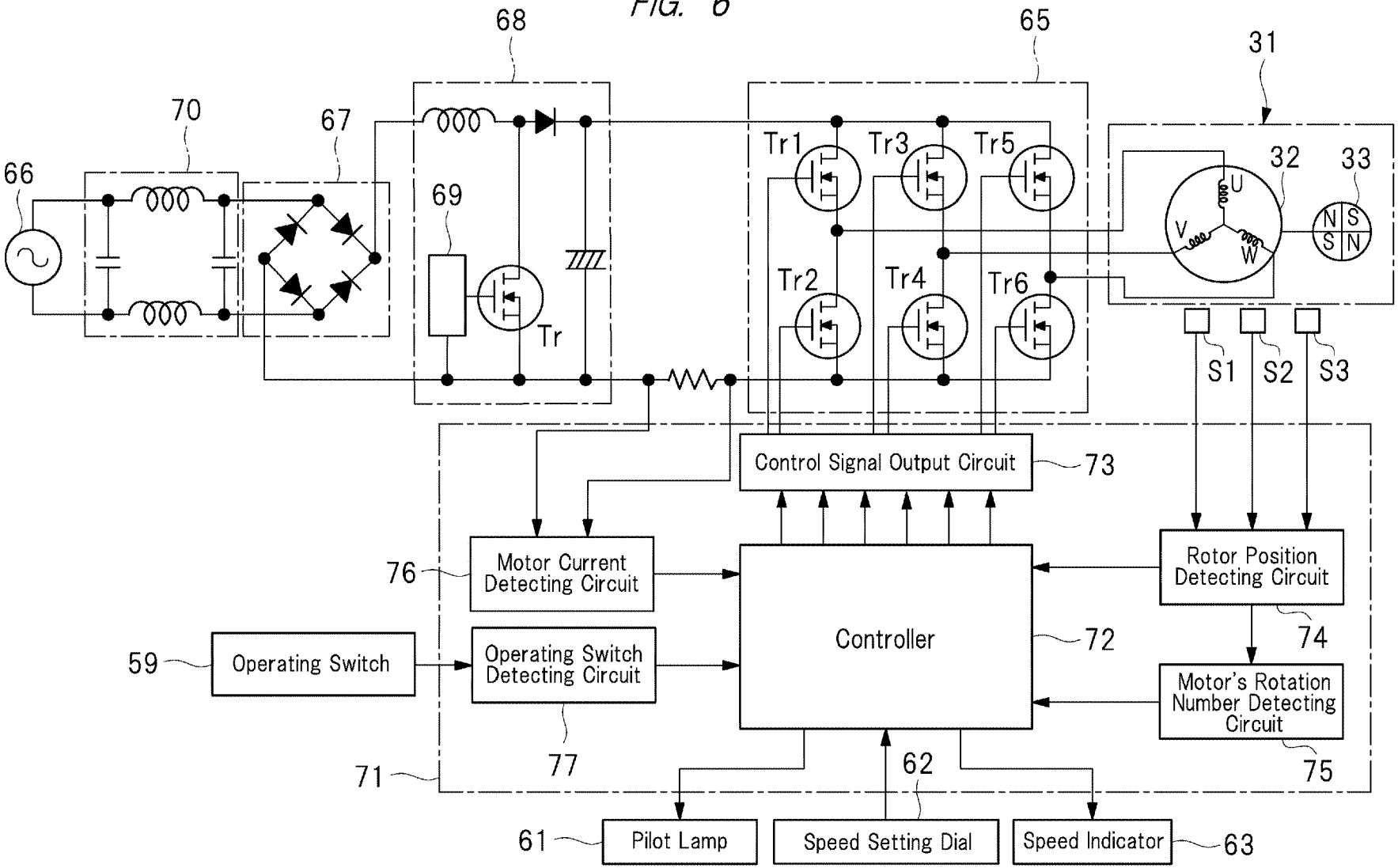
FIG. 6 is a block diagram showing a motor control circuit.

FIG. 6 is a block diagram of a motor control circuit for controlling the rotating speed of the brushless motor 31. As shown in FIG. 6, the stator 32 of the brushless motor 31 is wound with a U-phase coil, a V-phase coil, and a W-phase coil, and the rotor 33 is provided with four permanent magnets arranged circumferentially at intervals. To detect the rotation position of the rotor 33, the motor control circuit has three hall elements S1 to S3 corresponding to the coils of three phases and working as a rotation position detecting sensor. The hall elements S1 to S3 are mounted on a sensor board 64 shown in FIG. 2. Each of the hall elements S1 to S3 is a magnetic field detecting element which outputs a detection signal when finding by magnetic flux detection that the polarity of the rotor 33 is at the neutral point between its N pole and S pole. Based on a detection signal from each of the hall elements S1 to S3, the position of the rotor 33 is detected and a commutation action on each coil, i.e., current-supply switching action on the coil is carried out. The rotation position detecting sensor is not limited to the hall elements but may be provided as a hall IC made up of a hall element and an electronic circuit functioning as a comparator which are packaged in a single chip.

The motor control circuit has an inverter circuit 65 for controlling a drive current for the U-phase coil, the V-phase coil, and the W-phase coil. The inverter circuit 65 is supplied with power via a rectifying circuit 67 for rectifying an alternating current from a commercial power supply 66 into a direct current, and a power factor correcting (PFC) circuit 68 for raising a rectified DC voltage and supplying the raised DC voltage to the inverter circuit 65. The power factor correcting circuit 68 has an IC 69 for outputting a PWM control signal to a transistor Tr composed of a MOSFET (Metal-Oxide Semiconductor Field-Effect Transistor), thus keeping a higher harmonic current generated by switching elements in the inverter circuit 65 equal to or lower than a limit current through PWM control. Between the power supply 66 and the rectifying circuit 67, a noise-suppressing circuit 70 is provided, which prevents noises generated by the inverter circuit 65, etc., from reaching the power supply.

The inverter circuit 65 is a three-phase full-bridge inverter circuit and has a pair of switching elements Tr1 and Tr2, a pair of switching elements Tr3 and Tr4, and a pair of switching elements Tr5 and Tr6, each pair of switching elements being connected in series with each other, and respectively connected to the positive output terminal and the negative output terminal of the power factor correcting circuit 68. Three switching elements Tr1, Tr3, and Tr5 connected to the positive output terminal are high-side switching elements, while three switching elements Tr2, Tr4, and Tr6 connected to the negative output terminal are low-side switching elements. To a midpoint between the two switching elements Tr1 and Tr2, one connection terminal of the U-phase coil is connected. To a midpoint between the two switching elements Tr3 and Tr4, one connection terminal of the V-phase coil is connected. To a midpoint between the two switching elements Tr5 and Tr6, one connection terminal of the W-phase coil is connected. The other connection terminals of the U-phase, V-phase, and W-phase coils are connected to each other. Hence, the overall connection pattern of the coils is star connection. The connection pattern, however, may be delta connection. A MOSFET is used as each of the switching elements Tr1 and Tr6. For example, when a control signal is supplied to the gate of the high-side switching element Tr1, and to the gate of the low-side switching element Tr4, a current is supplied to the U-phase coil, and to the V-phase coil. Hence, by adjusting timing of supplying a control signal to each switching element, a commutation action on each switching element is controlled.

A motor control unit 71 for calculating a control signal and outputs it to the inverter circuit 65 has a controller 72, which sends a control signal to the inverter circuit 65 via a control signal output circuit 73. Each of the hall elements S1 to S3 serving as the rotation position detecting sensor sends a detection signal to a rotor position detecting circuit 74, which sends a signal to a motor's number of revolution detecting circuit 75, which outputs a signal corresponding to the motor's number of revolution, to the controller 72. A motor current detecting circuit 76 for detecting a current flowing through the motor 31 sends a detection signal corresponding to a motor current, to the controller 72. The controller 72 has a microprocessor for calculating a control signal, and a memory storing therein a control program, a calculation formula, data, etc.

When the worker presses the operating switch 59 of FIG. 2, an on-and-off detection signal is sent through an operating switch detecting circuit 77 to the controller 72. A pilot lamp 61 is connected to the controller 72, and when the plug of the feeder cable 58 is inserted in the commercial power supply socket, a turn-on signal is sent to the pilot lamp 61. The speed setting dial 62 is connected to the controller 72, and the motor 31 is driven to rotate at a rotating speed set by operating the speed setting dial 62. The number of revolutions of the motor, i.e., rotating speed of the motor is controlled by adjusting a voltage supplied to each coil. Voltage to the coils is controlled through PWM control over the switching elements by which the duty ratio of an on-signal applied to the gate of each of the switching elements Tr1 to Tr6 of the inverter circuit 65 is adjusted. For example, when the duty ratio is set to 20%, a voltage equivalent to 20% of an output voltage from the power factor correcting circuit 68 is supplied to each coil. When the duty ratio is set to 100%, the motor rotates with the maximum number of revolutions. To indicate a set rotating speed, a speed indicator 63 is connected to the controller 72. The inverter circuit 65, the rectifying circuit 67, the power factor correcting circuit 68, the motor control unit 71, etc., are mounted on the control board 78 of FIG. 2.

Figure 3:
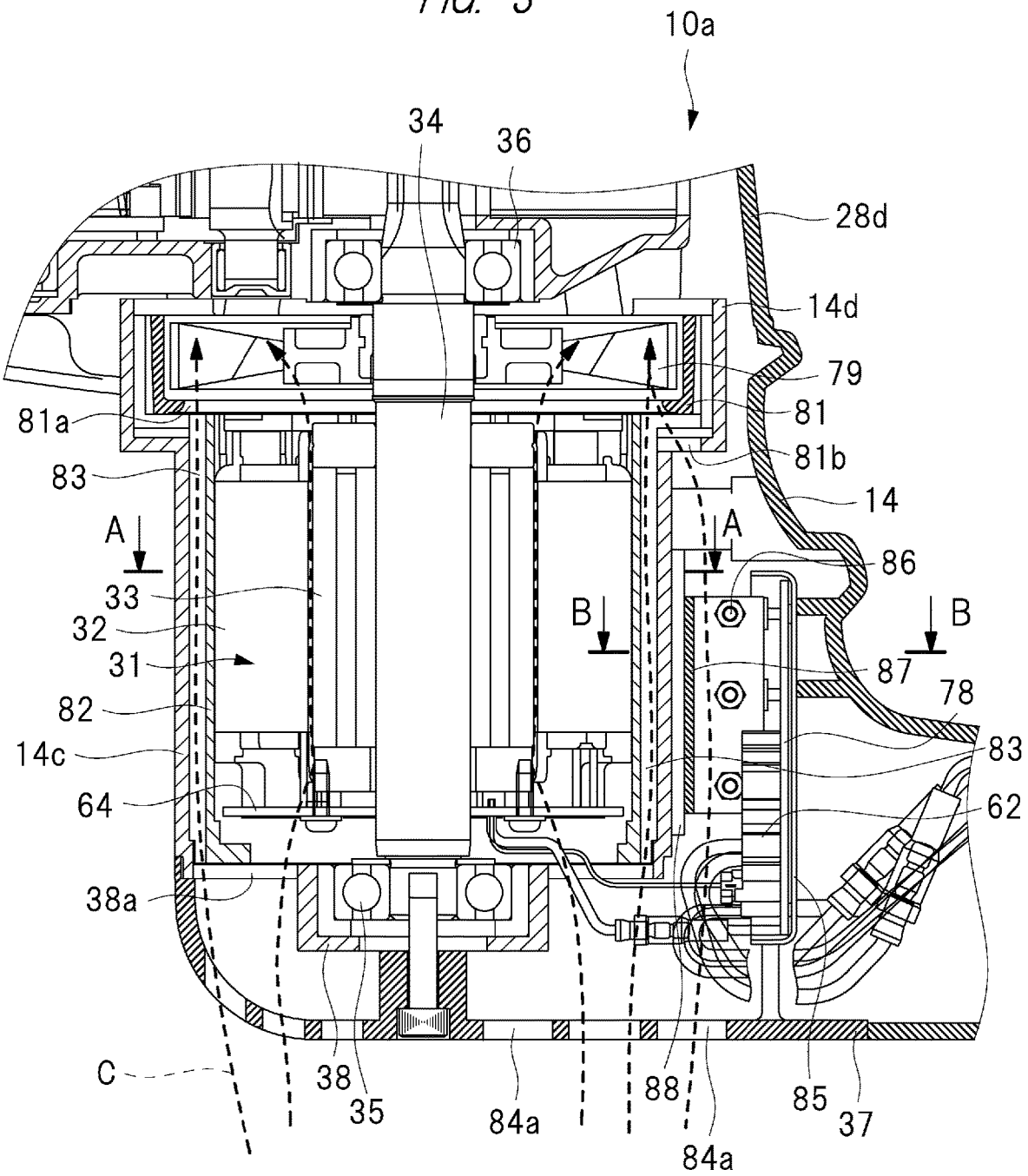
FIG. 3 is an enlarged sectional view showing a principal part of FIG. 2.
Figure 4:
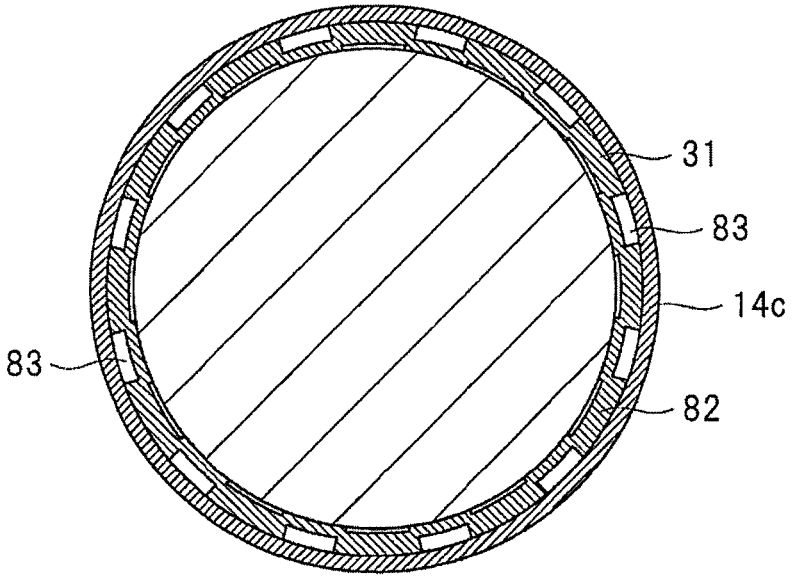
FIG. 4 is a sectional view taken along a line A-A in FIG. 3.
Figure 5:
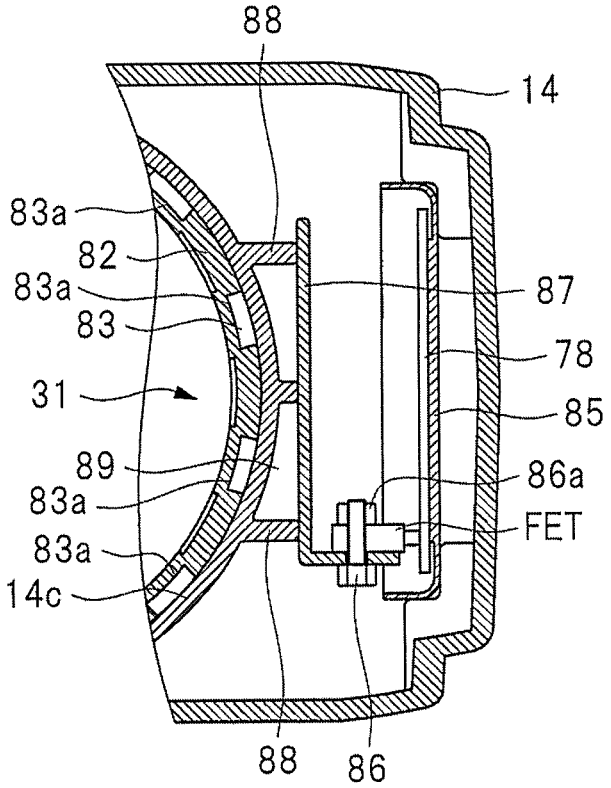
FIG. 5 is a sectional view taken along a line B-B in FIG. 3.

A fan 79 for generating cooling air is provided to the tip of the output shaft 34 of the motor 31, and the outer periphery of the fan 79 is covered with a cylindrical fan case 81. The fan 79 is an axial-flow fan, but may be provided as a centrifugal fan. As shown in FIGS. 3 to 5, the motor 31 has a resin motor case 82, which covers the cylindrical stator 32. The motor 31 is press fitted in a motor housing 14*c* made of aluminum alloy. Between the motor case 82 and the motor housing 14*c*, a cooling passage 83 allowing the cooling air to pass therethrough is formed, as shown in FIGS. 3 and 4. The cooling passage 83 is formed between multiple grooves 83*a* formed axially on the outer peripheral surface of the motor case 82 and the motor housing 14*c*. However, multiple grooves may be formed not on the outer peripheral surface of the motor case 82 but on the inner surface of the motor housing 14*c* so that the grooves of the motor housing 14*c* form the cooling passage 83. The cooling air generated by the rotation of the fan 79 flows through a gap between the stator 32 and the rotor 33 and through the cooling passage 83 to cool the brushless motor 31. The cooling passage 83 may be created by forming grooves on the outer peripheral surface of the motor case 82 as well as on the inner peripheral surface of the motor housing 14*c*. The cooling passage 83 is, therefore, created by forming the grooves at least on the motor case 82 or on the motor housing 14*c*. In FIG. 4, the interior of the motor case 82 is not shown.

In this manner, the motor housing 14*c* is made of aluminum alloy, and is exposed to an exterior portion, or an outside, thereby improving the rigidity of the housing 14, and improving the durability of the electric power tool. Since the motor housing 14*c* has heat conductivity higher than that of the resin motor case 82, the motor 31 can be cooled via the motor case 82, and particularly the motor 31 can be cooled even with the fan 79 being not rotated.

Since the motor is covered with the resin motor case 82, the motor 31 has an insulating structure which suppresses transmission of power and magnetic force acting on the motor 31 to the worker. Specifically, the electric power tool has a structure such that the aluminum motor housing 14*c* is exposed to the outside to give the electric power tool the rigidity of the motor housing 14*c* and the resin motor case 82 is interposed between the motor housing 14*c* and the motor 31 to prevent transmission of power acting on the motor 31 to the worker.

As described above, the motor case 82 is made of resin, and the motor housing 14*c* is made of material having heat conductivity higher than that of the resin, such as aluminum alloy. As one structure of the motor housing 14*c*, the motor housing 14*c* may be made entirely of aluminum alloy, and as another structure, the motor housing 14*c* may be partly exposed to the outside, that is, one part of the motor housing 14*c*, which covers part on the same side of the tool holder 12, is made of aluminum alloy, and the other part of the same is made of resin. In both structures, at least one part of the motor housing 14*c* is made of aluminum alloy, so that the heat dissipation performance of the cooling air flowing through the cooling passage 83 to cool the brushless motor 31 is improved. Making the motor housing 14*c* out of aluminum alloy gives the motor housing 14*c* strength greater than that of the motor housing 14*c* made of resin.

As shown in FIG. 3, the bottom cover 37 is formed with air holes 84*a*, and the bottom wall of the motor housing 14*c*, provided with the retainer 38, is provided with an air hole 38*a*. As shown in FIG. 2, air holes 84*b* and 84*c* are formed on the front and rear end parts of the top cover 39 on the top of the housing 14, respectively. Another air hole (not shown) is also formed on a side face of the housing 14. When the output shaft 34 is driven, fresh air is sucked in through the air holes 84*a* to generate cooling air, which is then discharged out of the air holes 84*b*, 84*c*, etc., on the upper side of the housing 14. Hence, in the housing 14, a cooling air channel is formed, along which cooling air sucked in through the air holes 84*a* passes through the air hole 38*a* and then is discharged out of the air holes 84*b*, 84*c*, etc., as shown by a broken line arrow in FIG. 3.

In such a configuration in which the wind passage is formed between the motor case 82 and the motor housing 14*c*, cooling air is caused to flow through the gap between the stator 32 and the rotor 33, through the cooling passage 83 between the motor case 82 and the motor housing 14*c*, and along the exterior of the motor housing 14*c*. The motor 31, therefore, can be cooled from inside and outside with cooling air generated by the fan, and heat generation by the motor housing 14*c* can be suppressed. This allows the worker to hold the motor housing 14*c* easily. Even when the fan 79 is not rotating, the motor housing 14*c* is readily cooled through the cooling passage 83 between the motor case 82 and the motor housing 14*c*. The retainer 38 making up part of the motor housing 14*c* is made of aluminum alloy, so that heat generated by the bearing 35 is transmitted through the retainer 38 to the motor housing 14*c*, which is exposed to the outside, and therefore releases the transmitted heat.

As shown in FIGS. 3 and 5, the control board 78 is housed in a pedestal board 85. The control board 78 is adjacent to the motor housing 14*c*, that is, disposed adjacent to the motor housing 14*c*, and fixed axially along the outer peripheral surface of the motor housing 14*c* inside the housing 14. Since the control board 78 is disposed between the brushless motor 31 and the bottom cover 37 covering an end face of the brushless motor 31, and adjacent to the motor housing 14*c*, the control board 78 is situated in the cooling air channel created by the fan 79, thereby improving the cooling characteristics of the control board 78.

The control board 78 has six switching elements Tr1 to Tr6 making up the inverter circuit 65. Each switching element is an FET, so that FIG. 5 shows an FET serving as the switching element. The control board 78 has the inverter circuit 65, the power factor correcting circuit 68, the motor control unit 71, etc., but in FIG. 5, only the switching element FET is indicated on the control board 78 whose other components are omitted.

To the switching element FET, a heat dissipating board, i.e., heat sink 87 is fixed with a screw 86 and a nut 86*a*. The heat sink 87 is abutted against multiple projections 88 projecting from the motor housing 14*c* toward the control board 78. In this manner, the control board 78 is connected to the motor housing 14*c* via the projections 88. In this structure, the projections 88 form sections of heat dissipation spaces 89 allowing cooling air to pass therethrough between the outer peripheral surface of the motor housing 14*c* and the heat sink 87. The heat sink 87 is made of a material having heat conductivity higher than that of resin, iron, etc., such as aluminum alloy and copper alloy. By attaching the heat sink 87 to the switching element, therefore, the cooling characteristics of the control board 78 and the switching element mounted thereon can be improved by cooling air flowing through the cooling passage 83 inside the motor housing 14*c*, cooling air flowing along the surface of the heat sink 87 outside the motor housing 14*c*, and cooling air flowing between the heat sink 87 and the control board 78.

As shown in FIG. 3, an opening 81*a* allowing cooling air to flow therein is formed on the bottom wall of the fan case 81. A large-diameter part 14*d* covering the exterior of the fan case 81 is provided on the upper end of the motor housing 14*c*. The large-diameter part 14*d* has a communication hole 81*b* which guides the cooling air flowing along the exterior of the motor housing 14*c* and the cooling air flowing between the heat sink 87 and the control board 78, into the fan case 81.

In this manner, by disposing the control board 78 in the cooling air channel "C" indicated by a broken line arrow, a motor cooling air is used as cooling air for cooling the brushless motor 31, and also as cooling air for cooling a heat-generating electronic device such as the inverter circuit 65. Among electronic devices mounted on the control board 78, the switching elements making up the inverter circuit 65 which performs communication control and speed control on the coil generate plenty of heat. However, by disposing the control board 78 in the cooling air channel "C", it is possible to allow the motor cooling air to cool the inverter circuit 65, prevent the overheating of the switching elements to improve the durability of the control board 78 including the switching elements, and prevent transmission of heat generated by the control board 78 to the housing 14 to improve the workability of the impact tool 10*a*.

Figure 7:
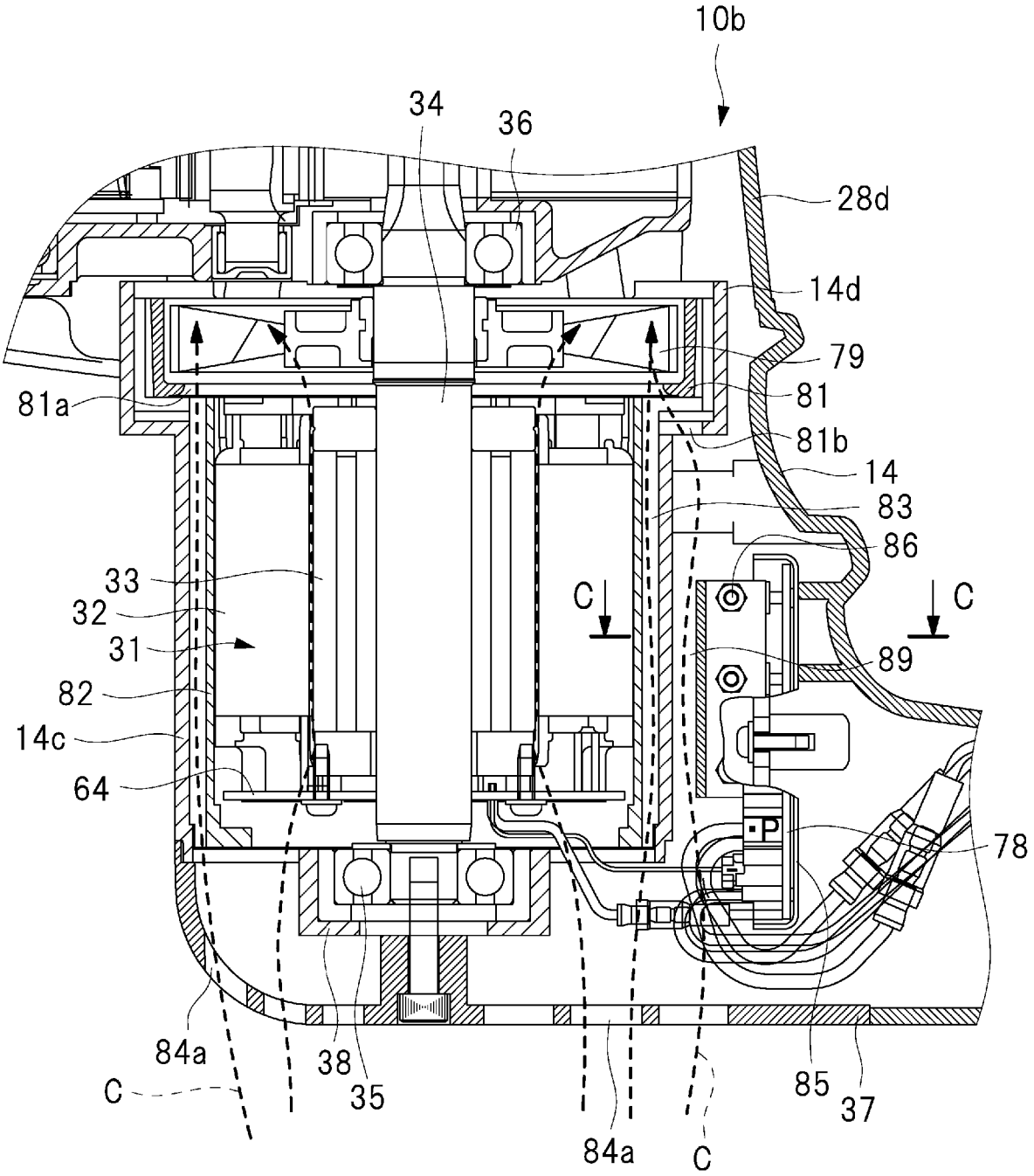
FIG. 7 is a sectional view showing a principal part of the impact tool as a variation.
Figure 8:
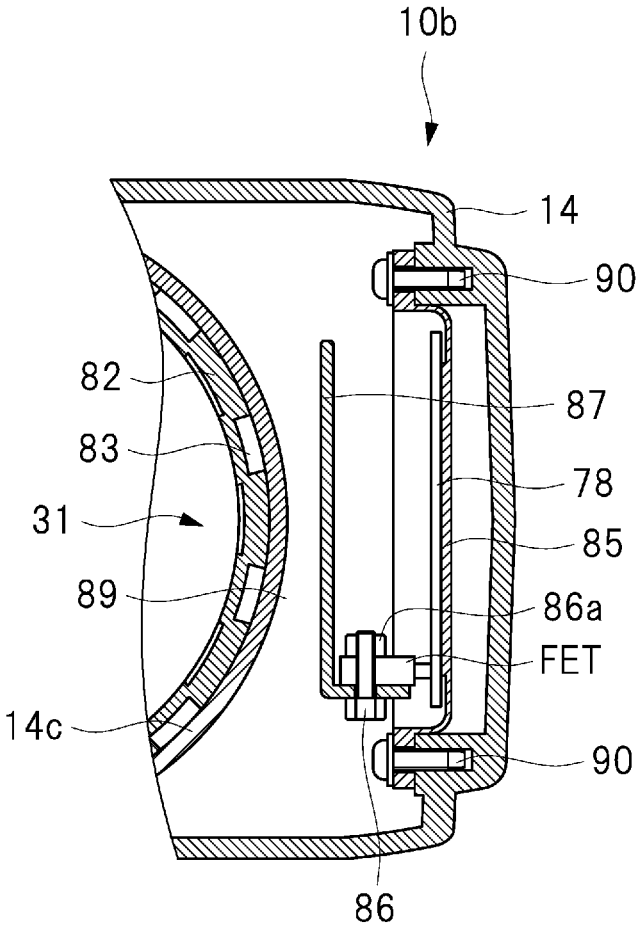
FIG. 8 is a sectional view taken along a line C-C in FIG. 7.

FIG. 7 is a sectional view of a principal part of an impact tool 10*b* as a variation. FIG. 8 is a sectional view taken along a line C-C of FIG. 7. According to the impact tool 10*b*, the projections 88 of FIG. 5 are not formed on the motor housing 14*c*. The heat sink 87 is separated from the surface of the motor housing 14*c* but is disposed close to the motor housing 14*c*. The heat dissipation space 89 is formed between the heat sink 87 and the outer peripheral surface of the motor housing 14*c*. The heat sink 87 is attached to the switching element FET with the screw 86, and the pedestal board 85 bearing the control board 78 is fixed to the housing 14 with a screw 90.

The heat sink 87 is disposed in the following two forms: the form shown in FIG. 5 in which the heat sink 87 is set in contact with the motor housing 14*c* and the form shown in FIG. 7 in which the heat sink 87 is disposed close to the motor housing 14*c*. In both forms, the control board 78 is disposed adjacent to the motor housing 14*c*, in which structure the cooling performance of the switching element can be improved via the heat sink 87.

Figure 9:
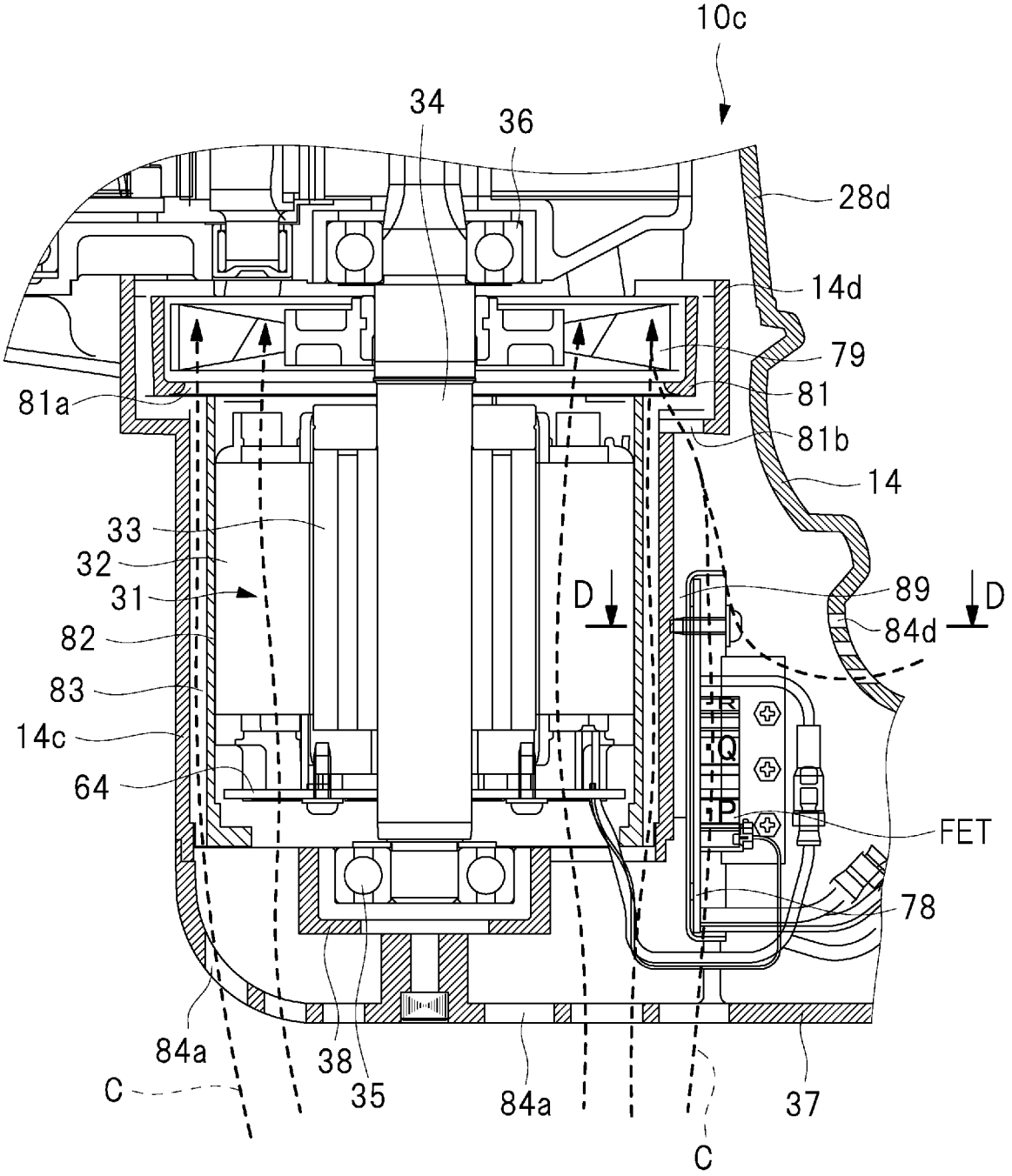
FIG. 9 is a sectional view showing a principal part of the impact tool as another variation.
Figure 10:
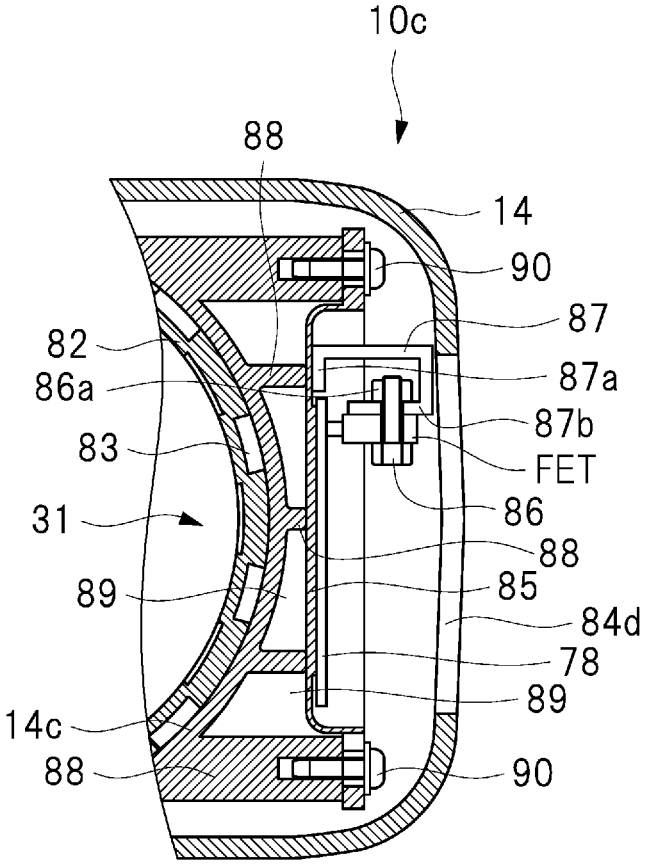
FIG. 10 is a sectional view taken along a line D-D in FIG. 9.

FIG. 9 is a sectional view of a principal part of an impact tool 10*c* as another variation. FIG. 10 is a sectional view taken along a line D-D of FIG. 9. According to the impact tool 10*c*, the motor housing 14*c* is provided with the projections 88 in the same manner as in the case of FIG. 5, and the pedestal board 85 is fixed to the projections 88 with the screw 90. In other words, the control board 78 with its front and back reversed from their positions of FIG. 5 is attached to the motor housing 14*c*. As shown in FIG. 10, the heat sink 87 has a quadrangular cross section, which shows that an abutment wall 87*a* is abutted against the pedestal board 85, and that the switching element FET is attached to an attachment wall 87*b* with the screw 86, the attachment wall 87*b* being perpendicular to the abutment wall 87*a*. The nut 86*a* screwed on the screw 86 is within a space encircled with the heat sink 87, into which space the cooling air flows.

As shown in FIGS. 9 and 10, an air hole 84*d* is formed on the housing 14 so as to face the control board 78. Therefore, in the impact tool 10*c* of FIGS. 9 and 10, when the fan 79 is driven, the cooling air is sent through the air hole 84*d* to the surface of the control board 78, in addition to the cooling air which is introduced through the air holes 84*a* formed on the bottom cover 37 so as to face the end of the motor 31.

Figure 1B:
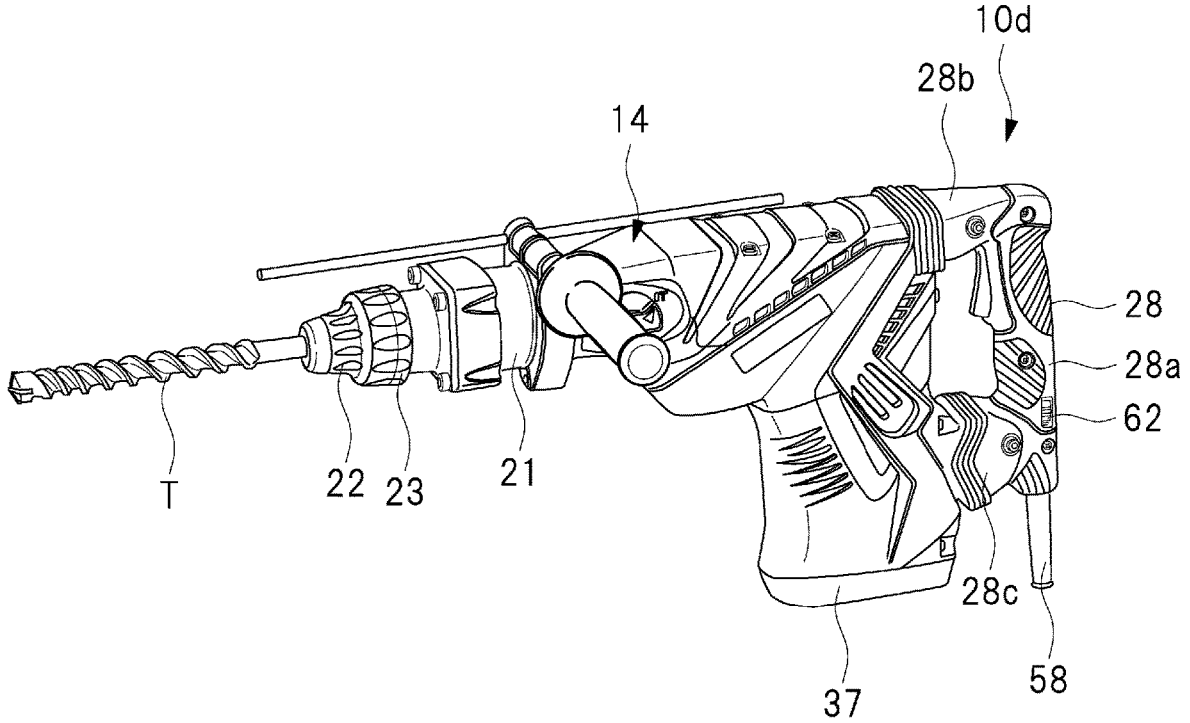
FIG. 1B is a perspective view showing an appearance of an impact tool as a variation.
Figure 11:
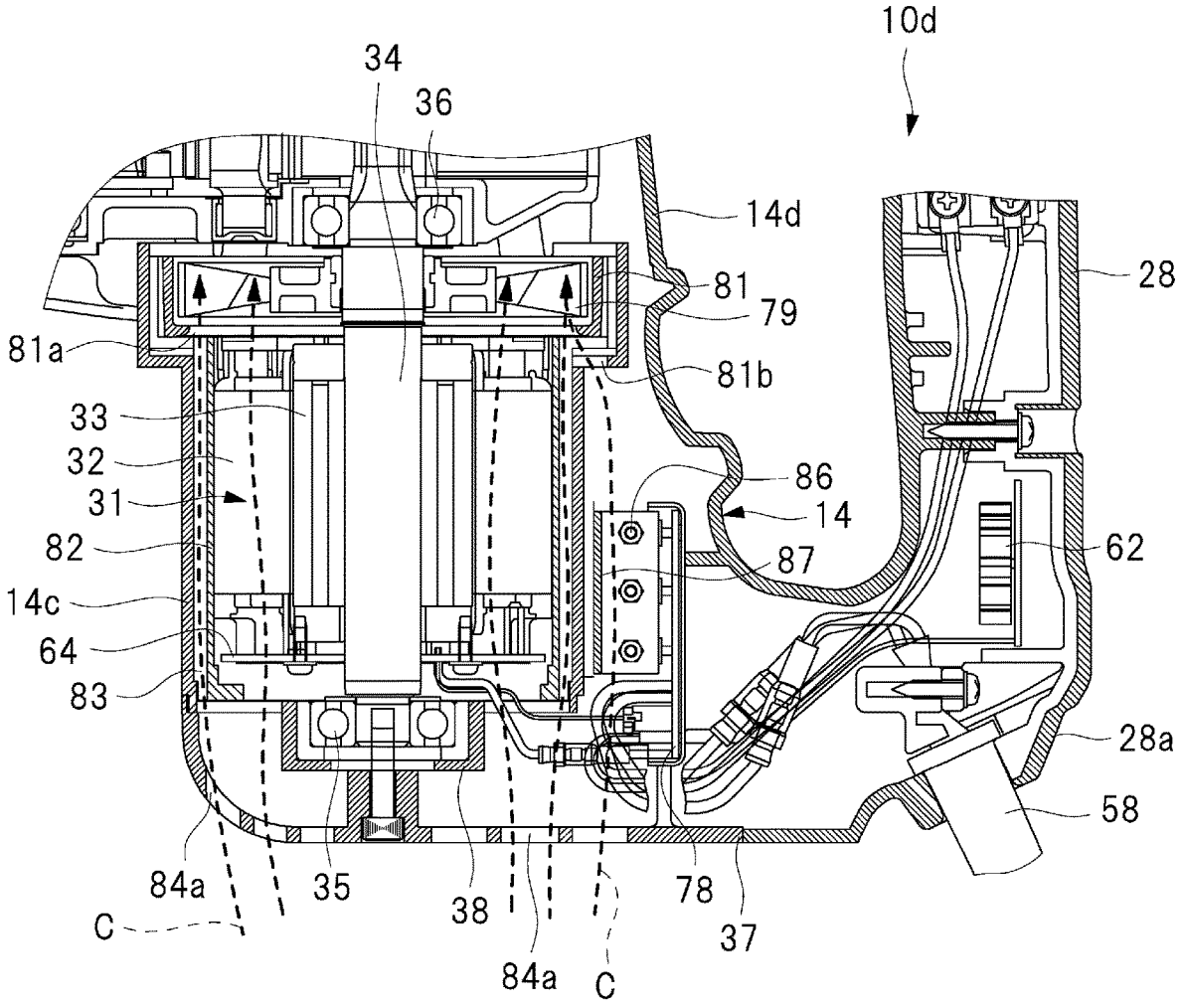
FIG. 11 is a sectional view showing a principal part of the impact tool as still another variation.

FIG. 11 is a sectional view of a principal part of an impact tool 10*d* as still another variation, showing part of the impact tool 10*d*, which is the same as part of the impact tool 10*a* shown in FIG. 3. The speed setting dial 62 of FIG. 2 mounted on the control board 78 is exposed to the outside on the side face of the housing 14. According to the impact tool 10*d*, the speed setting dial 62 is provided to the body 28*a* of the handle 28 such that, as shown in FIG. 1(B), the speed setting dial 62 is exposed on a side face of the body 28*a*.

Figure 12:
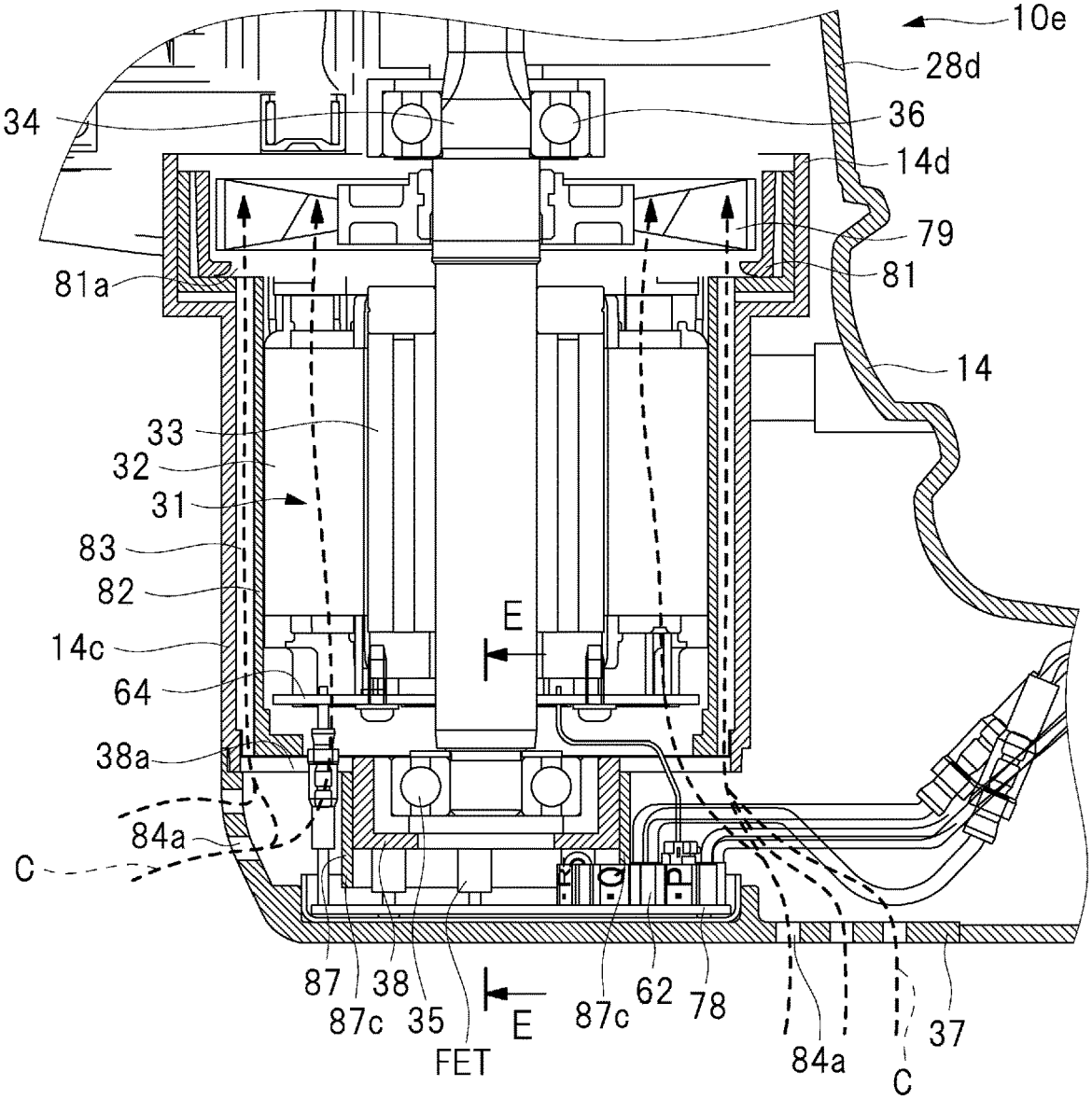
FIG. 12 is a sectional view showing a principal part of the impact tool as further variation.
Figure 13:
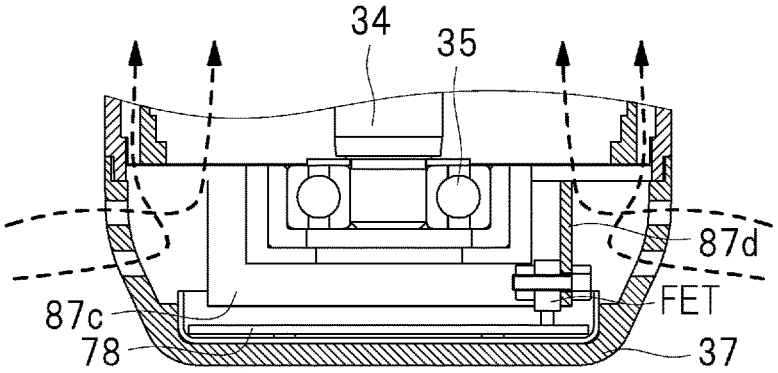
FIG. 13 is a sectional view taken along a line E-E in FIG. 12.

FIG. 12 is a sectional view of a principal part of an impact tool 10*e* as still another variation. FIG. 13 is a sectional view taken along a line E-E of FIG. 12. According to the impact tool 10*e*, the control board 78 is disposed on the bottom cover 37 making up part of the housing 14. The control board 78 has the speed setting dial 62, which is exposed on a side face of the bottom cover 37. The switching element FET is attached to the heat sink 87. The heat sink 87 has two parallel walls 87*c* parallel with each other and a connection wall 87*d* connecting respective ends of both parallel walls 87*c*. The heat sink 87 thus has a U-shaped cross section. Each parallel wall 87*c* is in contact with the retainer 38 in which the bearing 35 is incorporated, and the connection wall 87*d* forms a gap between the connection wall 87*d* and the retainer 38. The retainer 38 is made of aluminum alloy having high heat conductivity, and heat generated by the switching element FET is transmitted to the heat sink 87 and to the retainer 38. Because the heat sink 87 has an axially extending surface, the cooling air guided to the motor 31 flows along the heat sink 87. Hence the cooling performance of the switching element FET is improved.

Figure 14:
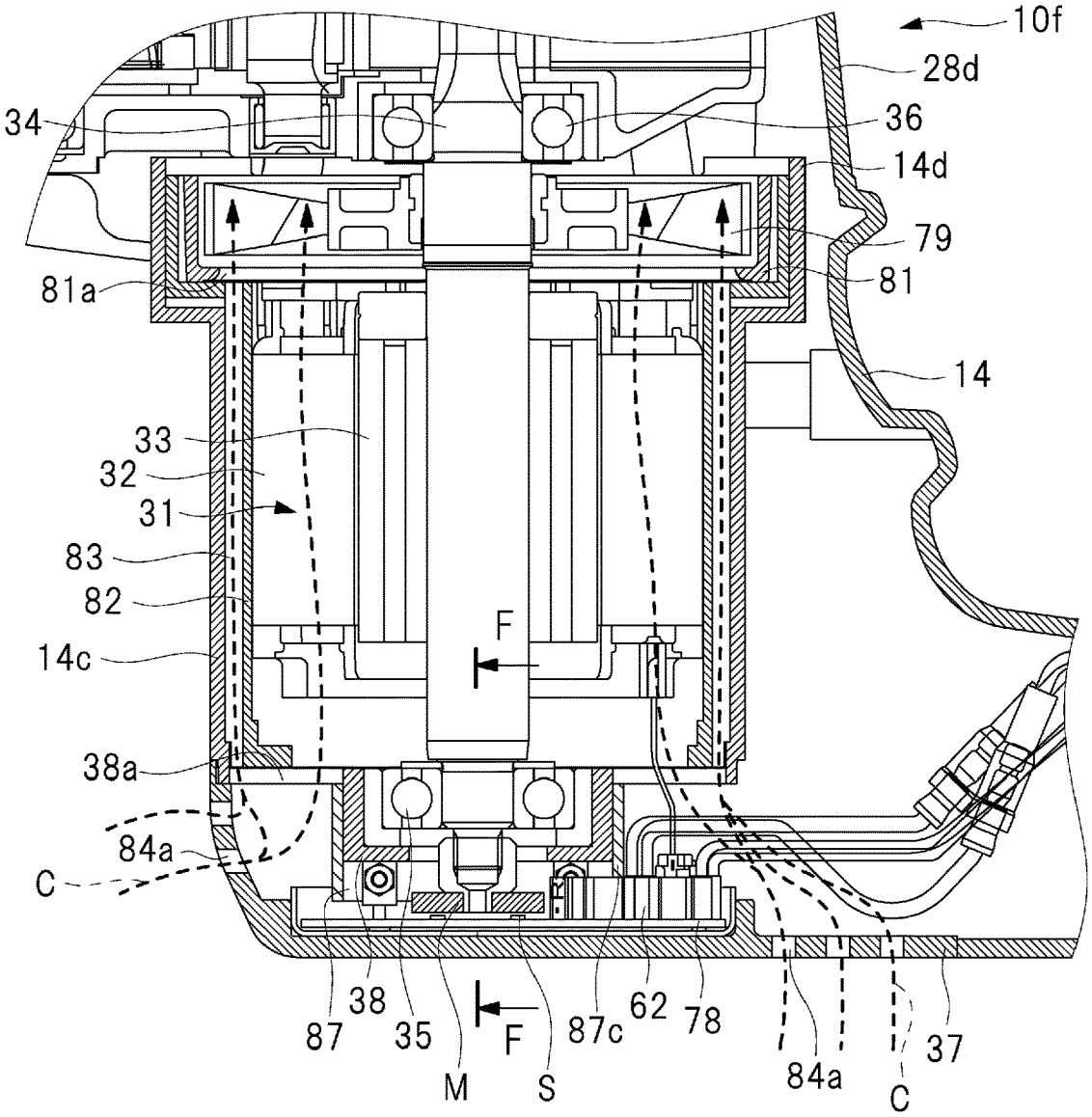
FIG. 14 is a sectional view showing a principal part of the impact tool as further variation.
Figure 15:
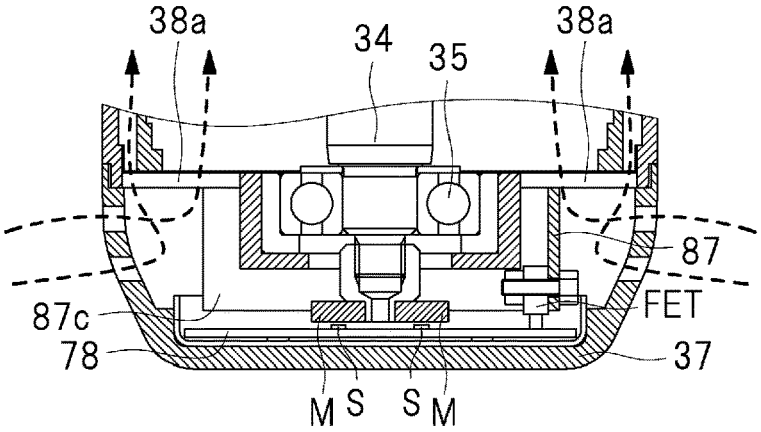
FIG. 15 is a sectional view taken along a line F-F in FIG. 12.

FIG. 14 is a sectional view of a principal part of an impact tool 10*f* as still another variation. FIG. 15 is a sectional view taken along a line F-F of FIG. 14. According to the impact tool 10*f*, in the same manner as the impact tool 10*e* of FIGS. 12 and 13, the control board 78 is disposed on the inner surface of the bottom cover 37 and the speed setting dial 62 is mounted on the control board 78. According to the impact tool 10*f*, hall elements "S" serving as a detection means detecting the rotation position of the rotor 33 are mounted on the control board 78, where the hall elements "S" sensitively response to sensor-driving permanent magnets "M" provided to the base end of the output shaft 34 and send output signals to the rotor position detecting circuit 74 of FIG. 6. Four permanent magnets "M" are arranged in correspondence to the four permanent magnets arranged on the rotor 33 so that both groups of magnets match in phase in the rotation direction. FIGS. 14 and 15 show two magnets and two hall elements "S" out of the four magnets and three hall elements "S". The heat sink 87 of the impact tool 10*f* has the same structure as that of the heat sink 87 of FIG. 12.

As shown in FIGS. 12 to 15, in the structural form in which the control board 78 is disposed on the inner surface of the bottom cover 37, the cooling air flowing through the cooling passage 83 inside the motor housing 14*c*, the cooling air flowing along the outer periphery of the motor housing 14*c*, and the cooling air flowing along the surface of the control board 78 are created in the housing 14. As shown in FIGS. 12 to 15, at least one part of the heat sink 87 is in contact with the retainer 38 made of aluminum alloy and the heat sink 87 is disposed close to the retainer 38. As a result, the control board 78 can be cooled by the motor housing 14*c* via the retainer 38.

Figure 16:
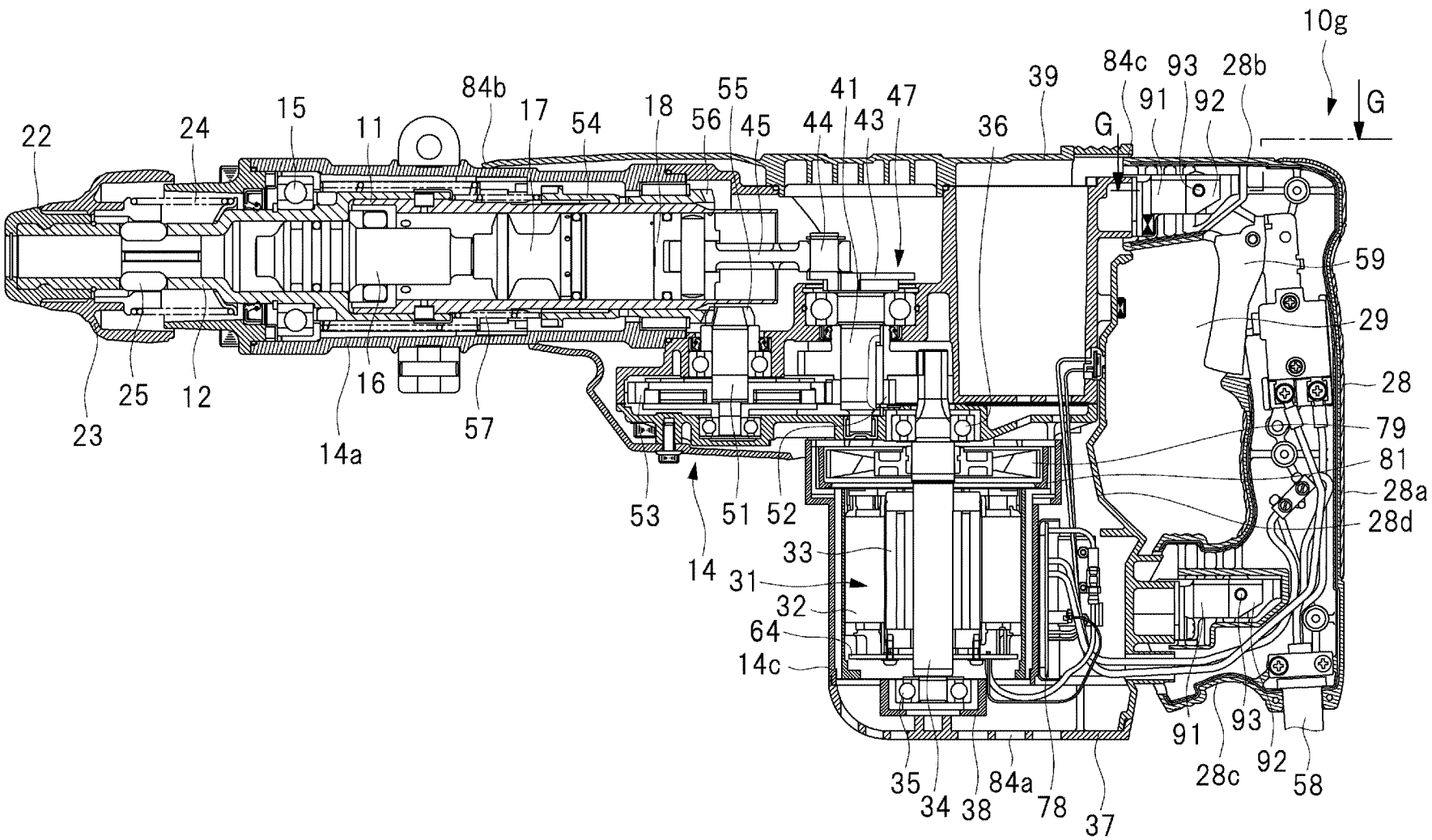
FIG. 16 is a longitudinal sectional view showing
Figure 17:
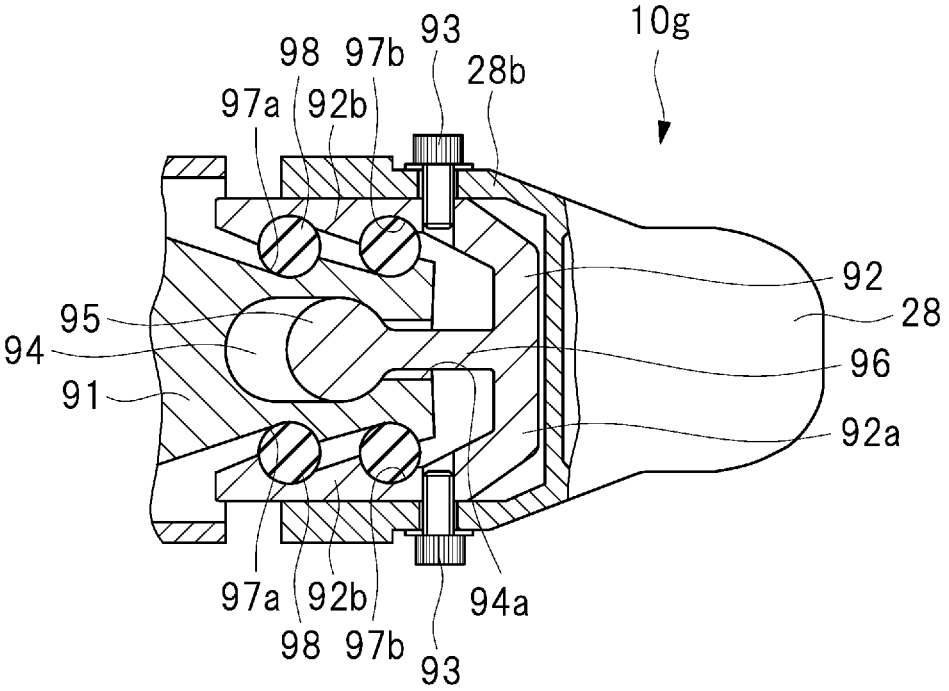
FIG. 17 is an enlarged sectional view taken along a line G-G in FIG. 16.

FIG. 16 is a sectional view of a principal part of an impact tool 10*g* as still another variation. FIG. 17 is a sectional view taken along a line G-G of FIG. 16. The impact tool 10*g* is different from the above impact tools in the direction of flow of the cooling air. According to the above impact tool 10*a*, etc., the air holes 84*a* formed on the bottom cover 37 serve as air intakes and the air holes 84*b*, 84*c*, etc., formed on the top of the housing 14 serve as discharge ports. According to the impact tool 10*g*, in contrast, the air holes 84*a* serve as discharge ports while the air holes 84*b*, 84*c*, etc., serve as air intakes. In other words, the cooling air flows through the cooling air channel "C" in the direction opposite to the direction in the above cases. In this manner, the cooling air flows through the cooling air channel "C" in the following two patterns: a pattern in which the cooling air flows from the base end of the motor 31 toward its tip and a pattern in which the cooling air flows from the tip of the motor 31 toward its base end. In the impact tool 10*g*, the pedestal board 85 bearing the control board 78 is abutted against the outer surface of the motor housing 14*c*.

If an air hole, i.e., an air intake is formed on the back face of the housing 14 as an additional air hole other than the air holes 84*c*, cooling air from the fan 79 is sucked in from the side of the grip space 29 of the handle 28 which is opposite to the tip tool "T". This offers an effect which dust hardly enters the impact tool.

As shown in FIG. 17, according to the impact tool 10*g*, a connection metal part 91 is attached to the rear end part of the housing 14 and a support metal part 92 having a U-shaped cross section is fixed inside the leg 28*b* of the handle 28 with screws 93. The support metal part 92 has a bottom wall 92*a* and side walls 92*b* formed integrally on both sides of the bottom wall 92*a*. The connection metal part 91 has a long hole 94 whose major axis extends in the axial direction of the cylinder 11, i.e., impact axis direction and which has an opening facing the support metal part 92 via a constricted part 94*a*. The support metal part 92 has a columnar part 95 capable of moving inside the long hole 94. This columnar part 95 is connected integrally to the bottom wall 92*a* of the support metal part 92 via a connection wall 96 having a width determined to be smaller than the outer diameter of the columnar part 95. A plurality of concaves 97*a* is formed on both sides of the connection metal part 91, while concaves 97*b* facing the respective concaves 97*a* are formed on the inner surfaces of the side walls 92*b* of the support metal part 92. The vibration-absorbing rubber elastic elements 98 are incorporated between the concaves facing each other, and a vibration-proof mechanism having the elastic elements 98 is incorporated in the leg 28*b*.

Another support metal part 92 similar to the above support metal part 92 is also fixed inside the leg 28*c* of the handle 28, and a connection metal part 91 fitted on this support metal part 92 is attached to the rear end part of the housing 14. In this manner, both legs 28*b* and 28*c* are connected to the housing 14 via the vibration-proof mechanisms shown in FIG. 17. As a result, vibrations transmitted from the housing 14 to the handle 28 are absorbed by the elastic elements 98. This improves the workability of the impact tool 10*g*.

Figure 18:
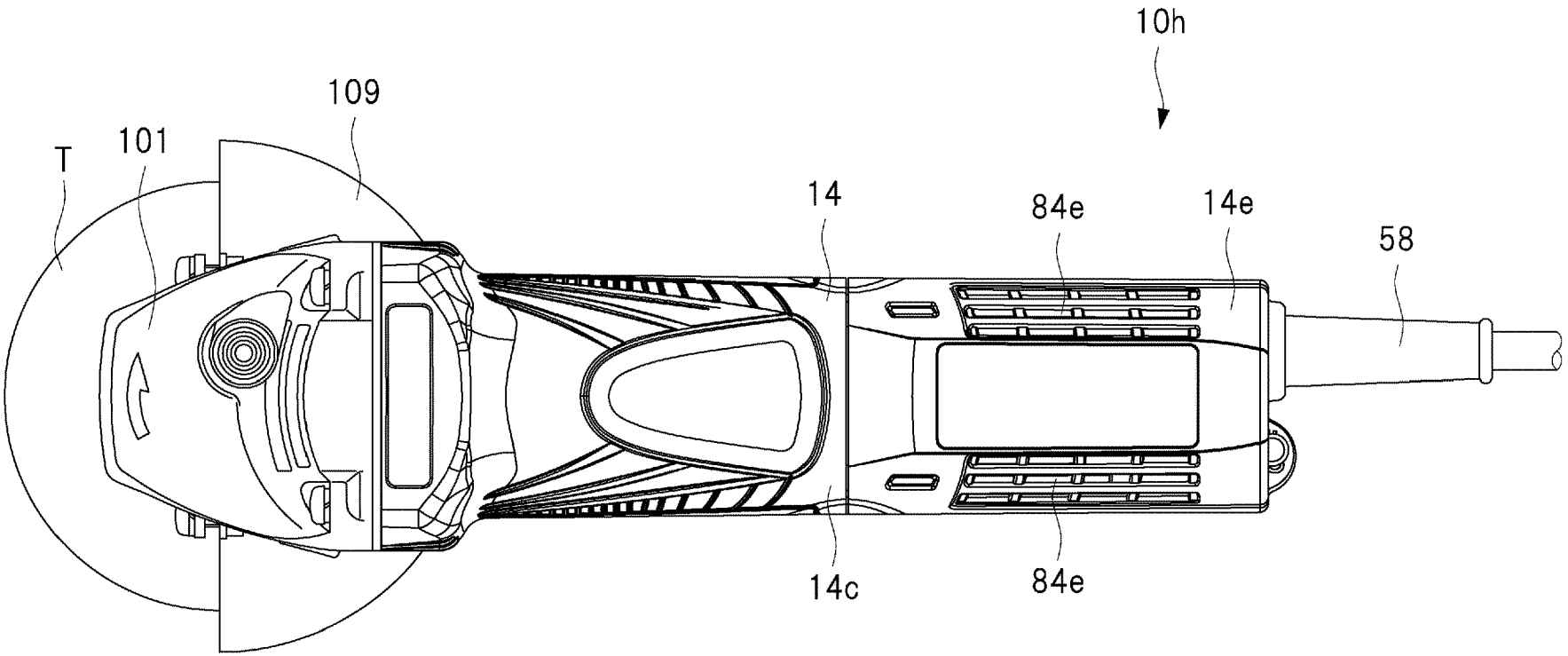
FIG. 18 is a plan view showing a principal part of a grinder as another example of the electric power tool.
Figure 19:
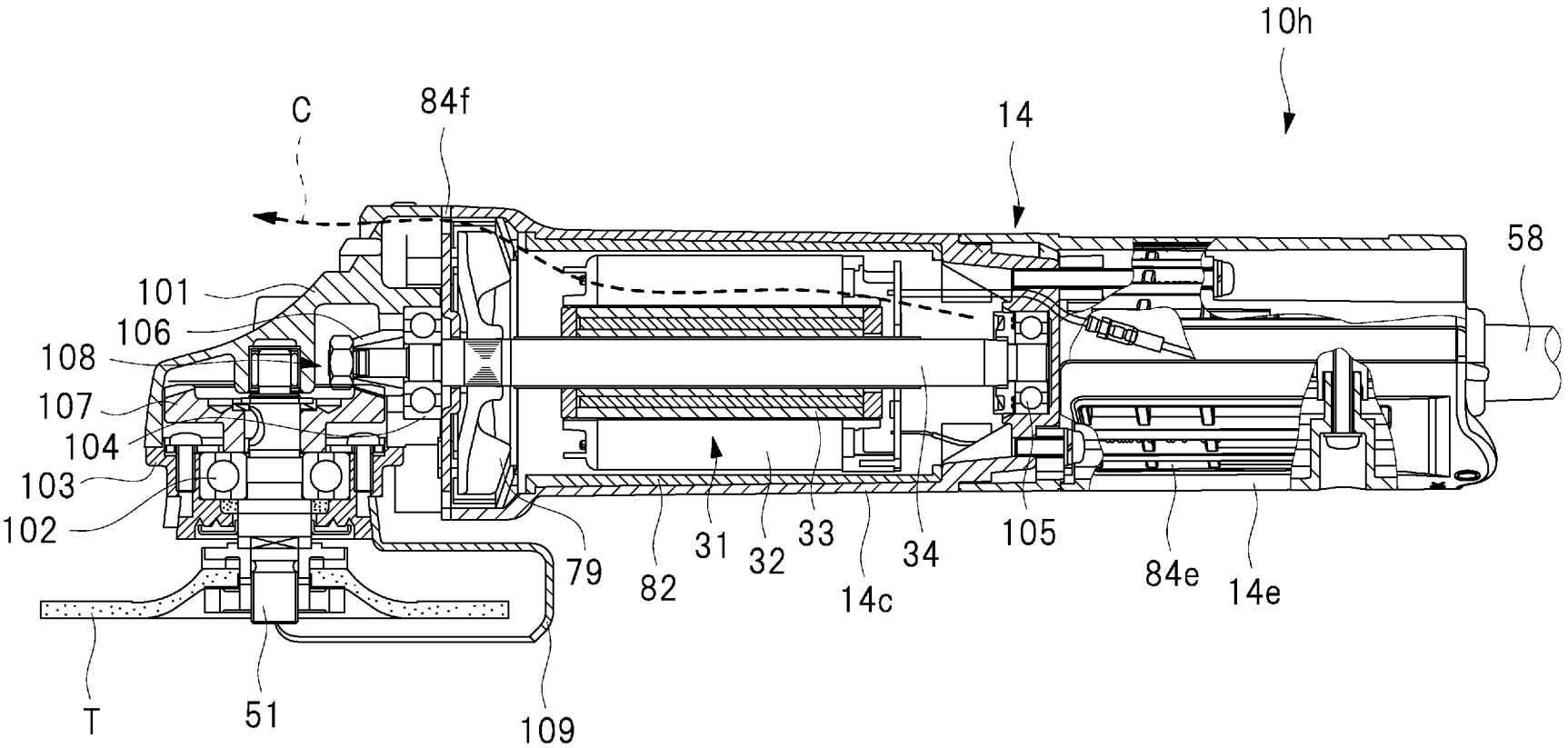
FIG. 19 is a longitudinal sectional view of FIG. 18.
Figure 20:
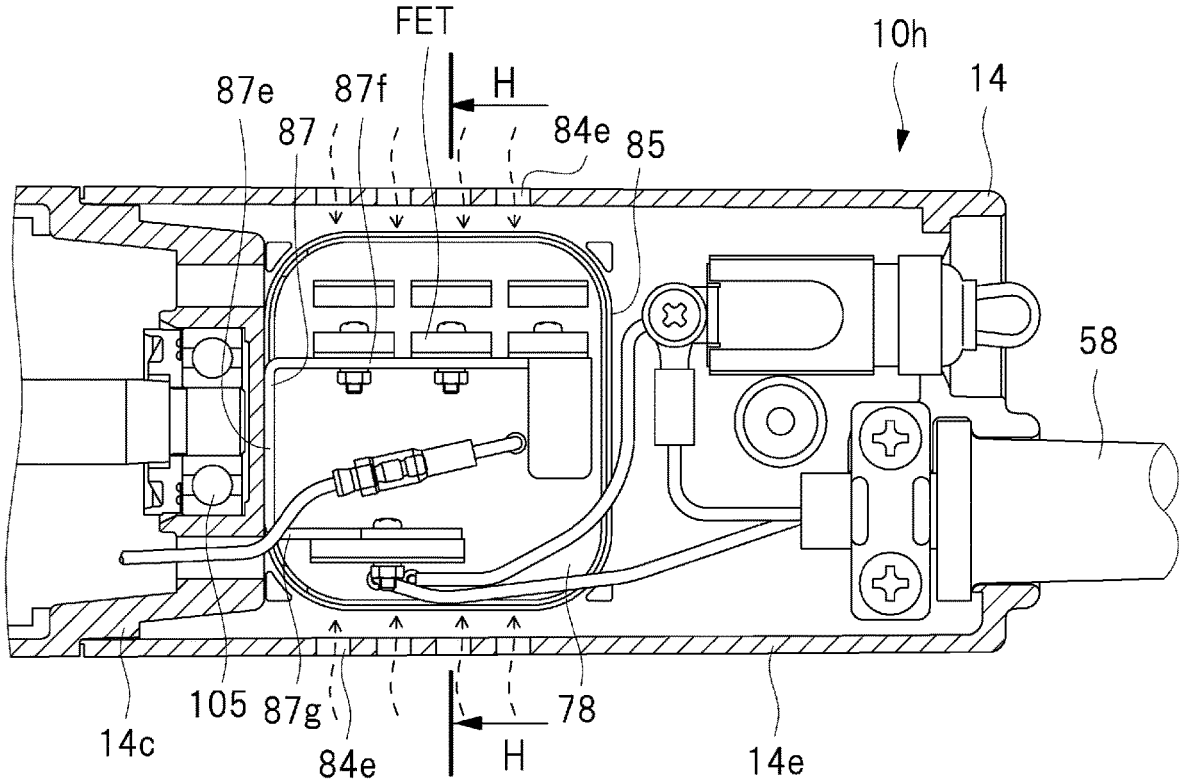
FIG. 20 is an enlarged sectional view showing a principal part of the grinder.
Figure 21:
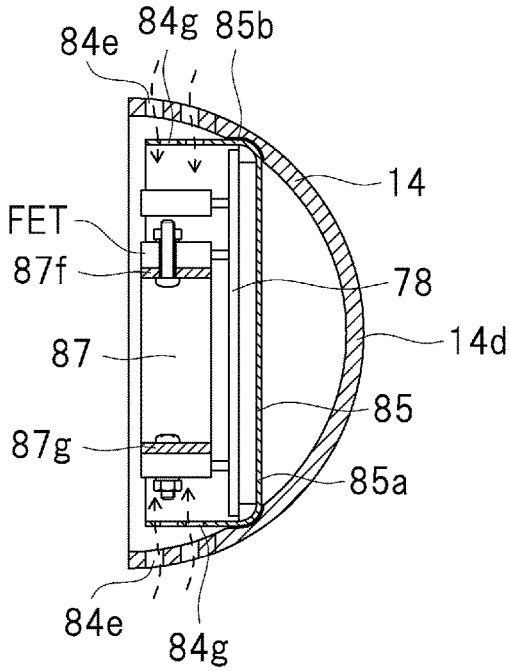
FIG. 21 is a sectional view taken along a line H-H in FIG. 20.

FIG. 18 is a plan view of a grinder 10*h* as another example of the electric power tool, and FIG. 19 is a longitudinal sectional view of the grinder 10*h* of FIG. 18. FIG. 20 is an enlarged sectional view of the interior of the base housing of the grinder, and FIG. 21 is a sectional view of FIG. 20 taken along a line H-H.

The grinder 10*h* has the motor housing 14*c* housing the brushless motor 31 therein, and a base housing 14*e* is attached to the base end of the motor housing 14*c*. Both motor housing 14*c* and base housing 14*e* are made of aluminum alloy and jointly form the housing 14 of the grinder 10*h*. The motor 31 has the cylindrical stator 32 wound with coils and the rotor 33 incorporated in the stator 32 in the same manner as the above described motor 31. The rotor 33 is fitted with the output shaft 34, which outputs the rotating drive force of the motor 31.

A grinding head, i.e., tool head 101 is attached detachably to the tip of the motor housing 14*c*, and the tip of the output shaft 34 projects into the tool head 101. On the tool head 101, the rotation transmission shaft 51 set perpendicular to the output shaft 34 is supported rotatably via a bearing 102, and a grindstone serving as the tip tool "T" is attached to the rotation transmission shaft 51. The bearing 102 is fitted to an annular retainer 103 attached to the front face of the tool head 101. The tip of the output shaft 34 is supported by a bearing 104 fitted to the tool head 101, while the rear end part of the output shaft 34 is supported by a bearing 105 attached to the housing 14*c*. To transmit the rotation of the output shaft 34 to the rotation transmission shaft 51, a driving bevel gear 106 is attached to the tip of the output shaft 34 while a driven bevel gear 107, which engages with the driving bevel gear 106, is attached to the rotation transmission shaft 51. When the brushless motor 31 is driven, the rotation transmission shaft 51 is driven via a motion transmission mechanism 108 composed of the bevel gear 106, etc. As a result, the grindstone, i.e., tip tool "T" is driven to rotate. The retainer 103 is provided with a grindstone cover 109 covering the rear of the tip tool "T".

The fan 79 is provided to the tip of the output shaft 34, and generates cooling air in the housing 14. A plurality of air holes 84*e* are formed on the base housing 14*e*, and an air hole 84*f* is formed between the tip of the housing 14 and the tool head 101. As a result, when the motor 31 is driven, cooling air generated inside the housing 14 by the fan 79 flows through the cooling air channel "C" leading from the base end of the housing 14 to its tip, as shown by a broken line arrow.

In the base housing 14*e*, the control board 78 is disposed adjacent to the motor housing 14*c* made of aluminum alloy, as shown in FIGS. 20 and 21. The heat sink 87 is attached to the control board 78, and has an abutment wall 87*e* extending in the width direction of the housing 14 and abutted against the motor housing 14*c* and vertical walls 87*f* and 87*g* extending from both ends of the abutment wall 87*e* in the longitudinal direction of the housing 14. The vertical wall 87*f* has the switching element FET mounted thereon. In this manner, because the switching element FET is mounted on the heat sink 87 in contact with the motor housing 14*c* near the bearing, the aluminum motor housing 14*c* is connected to the switching element FET via the heat sink 87. Hence, the switching element FET can be cooled by the motor housing 14*c*.

The control board 78 is provided to the pedestal board 85, which extends in the longitudinal direction of the housing 14 and is fixed to the base housing 14*e*. The pedestal board 85 has a bottom wall 85*a* and side walls 85*b* connected integrally to the outer periphery of the bottom wall 85*a*. On the side walls 85*b*, air holes 84*g* are formed to be counter to the air holes 84*e*. As a result, when the fan 79 is driven to rotate, outer air flows through the air holes 84*e* into the housing 14, in which the incoming outer air flows through the air holes 84*g* to hit the switching element FET in the pedestal board 85, thus cooling the control board 78, the heat sink 87, and the switching element FET. The incoming outer air having passed through the air holes 84*e* flows along the control board 78 and then flows through the motor 31 to be finally discharged out of the air hole 84*f*.

As shown in FIG. 20, the pedestal board 85 functioning as a heat sink is in contact with the motor housing 14*c* made of aluminum alloy. However, a gap may be formed between the pedestal board 85 and the motor housing 14*c*.

The present invention is not limited to the above embodiments, and may be modified into various forms without departing from the scope of the invention. For example, while the electric power tool shown in the drawings is actuated with power from a commercial power supply, the present invention may be applied to a battery-powered electric power tool which is actuated with power from secondary battery cells in a battery case housed in the housing 14. Furthermore, the present invention applies not only to the hammer drill and the grinder but also to other types of electric power tools whose tip tool is driven by the brushless motor.

The invention claimed is:

1. An electric power tool comprising:

a housing of the electric power tool;

a brushless motor having a stator and a rotor, and driving a tip tool; and a cooling fan which is driven by the brushless motor, wherein:

the housing comprises a motor housing at least partly covering an outer periphery of a motor case of the brushless motor, the motor housing is exposed to outer air, a control board having a control circuit for controlling the rotation of the brushless motor is disposed adjacent to an outer periphery of the motor housing and along an axial direction of the rotor, the housing has an air hole formed on opposite side of the cooling fan, an inner-periphery-side passage of cooling air for cooling the brushless motor is provided inside the motor housing, and allows the cooling air for cooling the brushless motor to flow in an axial direction of the rotor from the air hole through the inside the motor housing to the cooling fan, an outer-periphery-side passage of cooling air for cooling the control board is separately provided outside the motor housing so that a side wall of the motor housing intervenes between the inner-periphery-side passage and the outer-periphery-side passage, and allows the cooling air for cooling the control board to flow in the axial direction of the rotor from the air hole through the outside the motor housing to the cooling fan so that the cooling air for cooling the control board flows from the air hole to the cooling fan in a same direction as the cooling air for cooling the brushless motor flows from the air hole to the cooling fan, and a communication passage is provided on the motor housing and connects the inner-periphery-side passage and the outer-periphery-side passage so that the cooling air for cooling the control board joins the cooling air for cooling the brushless motor after the cooling air for cooling the brushless motor completes passing through a part of the inner-periphery-side passage that extends over a length of the brushless motor in the axial direction of the rotor.

2. The electric power tool according to claim 1, wherein a heat dissipation space through which the cooling air for cooling the control board passes is formed between the control board and the motor housing.

3. The electric power tool according to claim 2, comprising a plurality of projections so formed on the motor housing as to project outward, wherein the control board is connected to the motor housing via the projections, and sections of the heat dissipation spaces are formed by the motor housing, the projections, and the control board.

4. The electric power tool according to claim 1, wherein the control board is provided with a heat sink which is set in contact with or disposed close to the motor housing.

5. The electric power tool according to claim 1, wherein the inner-periphery-side passage is formed by at least one groove formed axially on at least one of an outer peripheral surface of the motor case and an inner peripheral surface of the motor housing.

6. The electric power tool according to claim 1, wherein the control board is provided with detecting means for detecting a rotation position of the brushless motor.

7. The electric power tool according to claim 1, comprising:

a tool holder which holds the tip tool;

a motion converting mechanism for converting the rotation of an output shaft of the motor into reciprocation of the tool holder, the reciprocation being made in a direction perpendicular to the output shaft;

a handle disposed closer to a base end of the tool holder; and a crankshaft which transmits a torque of the output shaft to the motion converting mechanism, wherein the housing comprises a gear housing that houses the motion converting mechanism and the crankshaft, wherein the brushless motor is disposed so that the output shaft is perpendicular to a direction of the reciprocation of the tool holder, wherein the handle has a body and two legs formed on both ends of the body such that they are separated from each other across the body and are attached to a rear end part of the housing, and wherein one of the legs is disposed closer to the gear housing while the other of the legs is disposed closer to the motor housing.

8. The electric power tool according to claim 7, wherein a speed setting means operated by a worker to set a rotating speed of the motor is disposed in the handle.

9. The electric power tool according to claim 7, wherein the control board is disposed between the other of the legs and the motor.

10. The electric power tool according to claim 1, wherein the cooling air for cooling the control board joins the cooling air for cooling the brushless motor before the cooling air for cooling the brushless motor enters the cooling fan.

11. An electric power tool comprising:

a brushless motor driving a tip tool;

a motor case having a first cylindrical shape, the motor case covering the brushless motor;

a motor housing made of aluminum alloy, the motor housing having a second cylindrical shape, the motor housing at least partly covering the motor case such that an outer lateral surface of the motor case and an inner lateral surface of the motor housing face each other, a first portion of an outer lateral surface of the motor housing being exposed to outside the electric power tool;

a control board having a control circuit for controlling rotation of the motor; and a pedestal board including a first surface on which the control board is disposed, the first surface of the pedestal board being parallel to a longitudinal axis of the motor housing, wherein the control circuit includes switching elements controlling a current flowing in coils provided to a stator of the brushless motor, and wherein a heat sink is attached to the switching elements.

12. The electric power tool according to claim 11, wherein the outer lateral surface of the motor case includes a first portion, a second portion, and a third portion, wherein the first portion, the second portion, and the third portion are circumferentially disposed about a longitudinal axis of the motor case, wherein the second portion is disposed between the first portion and the third portion, and while the first portion and the third portion of the outer lateral surface of the motor case are directly in contact with the inner lateral surface of the motor housing, the second portion of the outer lateral surface of the motor case does not contact the inner lateral surface of the motor housing to create a first air passage for allowing first cooling air for cooling the brushless motor to flow through.

13. The electric power tool according to claim 12, further comprising a housing for the electric power tool, wherein the housing for the electric power tool includes at least one air hole to intake the first cooling air for cooling the brushless motor and second cooling air for cooling the control board from outside the housing into inside the housing, wherein a second air passage is disposed between the control board and the second portion of the outer lateral surface of the motor housing such that the second cooling air entering the housing for the electric power tool through the air hole flows the second air passage to cool the control board, and wherein the first air passage is parallel to the second air passage.

14. The electric power tool according to claim 13, wherein the pedestal board is sandwiched between a second portion of the outer lateral surface of the motor housing and the housing for the electric power tool, and wherein the second portion of the outer lateral surface of the motor housing is different from the first portion of the outer lateral surface of the motor housing.

15. The electric power tool according to claim 11, wherein the first surface of pedestal board and a second portion of the outer lateral surface of the motor housing face each other, and wherein the second portion of the outer lateral surface of the motor housing is different from the first portion of the outer lateral surface of the motor housing.

16. The electric power tool according to claim 11, wherein a second surface of pedestal board and a second portion of the outer lateral surface of the motor housing face each other, wherein the second surface of the pedestal board is disposed opposite the first surface of the pedestal board, and wherein the second portion of the outer lateral surface of the motor housing is different from the first portion of the outer lateral surface of the motor housing.

* * * * *